US010661412B2

(12) United States Patent
Fukui et al.

(10) Patent No.: US 10,661,412 B2
(45) Date of Patent: May 26, 2020

(54) CLAMP APPARATUS

(71) Applicant: SMC CORPORATION, Chiyoda-ku (JP)

(72) Inventors: Chiaki Fukui, Abiko (JP); Kazuyoshi Takahashi, Koto-ku (JP); Hideki Sasaki, Toride (JP); Masaharu Kobayashi, Tsukubamirai (JP)

(73) Assignee: SMC CORPORATION, Chiyoda-ku (JP)

( * ) Notice: Subject to any disclaimer, the term of this patent is extended or adjusted under 35 U.S.C. 154(b) by 27 days.

(21) Appl. No.: 14/900,405

(22) PCT Filed: Jul. 10, 2014

(86) PCT No.: PCT/JP2014/068969
§ 371 (c)(1),
(2) Date: Dec. 21, 2015

(87) PCT Pub. No.: WO2015/008807
PCT Pub. Date: Jan. 22, 2015

(65) Prior Publication Data

US 2016/0136789 A1 May 19, 2016

(30) Foreign Application Priority Data

Jul. 18, 2013 (JP) ..... 2013-149957
Feb. 24, 2014 (JP) ..... 2014-033166

(51) Int. Cl.
*B25B 5/06* (2006.01)
*B25B 5/00* (2006.01)

(52) U.S. Cl.
CPC ..... *B25B 5/064* (2013.01); *B25B 5/003* (2013.01)

(58) Field of Classification Search
None
See application file for complete search history.

(56) References Cited

U.S. PATENT DOCUMENTS 4,537,389 A * 8/1985 Kancnik ..... B25B 5/087 269/234
4,845,834 A * 7/1989 Watson ..... B23Q 3/1554 483/31

(Continued)

FOREIGN PATENT DOCUMENTS

CN 103029078 * 4/2013 ..... B25B 11/00
JP 59-88263 A 5/1984

(Continued)

OTHER PUBLICATIONS

Translation of CN 103029078.*

(Continued)

*Primary Examiner* — Brian D Keller
(74) *Attorney, Agent, or Firm* — Oblon, McClelland, Maier & Neustadt, L.L.P.

(57) ABSTRACT

A clamp apparatus including two pairs of first and second clamp arms, which are supported rotatably with respect to a body and are disposed mutually in parallel. First and second cam members including respective cam surfaces are provided on ends of the first and second clamp arms. The first cam members are pressed by rollers upon lowering of a block body under a driving action of a first cylinder that makes up a drive unit. The first clamp arms are rotated to assume a clamped state. The second cam members are pressed by rollers upon lowering of a block body under a driving action of a second cylinder of the drive unit, whereby the second clamp arms are rotated to assume a clamped state.

16 Claims, 17 Drawing Sheets

(56) References Cited

U.S. PATENT DOCUMENTS

| | | | | |
|---|---|---|---|---|
| 4,995,146 | A * | 2/1991 | Woods | B25B 5/003 269/45 |
| 5,408,737 | A * | 4/1995 | Mailey | B25B 5/062 269/24 |
| 5,820,118 | A * | 10/1998 | Craft | B25B 5/062 269/24 |
| 2001/0050455 | A1 | 12/2001 | Takahashi | |
| 2002/0005608 | A1* | 1/2002 | Ausilio | B25B 5/006 269/32 |
| 2004/0113343 | A1* | 6/2004 | McIntosh | B25B 5/087 269/32 |
| 2005/0230004 | A1* | 10/2005 | Miller | B27L 5/04 144/332 |
| 2012/0073353 | A1 | 3/2012 | McNally | |
| 2014/0250675 | A1* | 9/2014 | Sherrill | B23Q 3/064 29/559 |

FOREIGN PATENT DOCUMENTS

| | | | |
|---|---|---|---|
| JP | 60-57957 | A | 12/1985 |
| JP | 63-189481 | U | 12/1988 |
| JP | 5-111728 | A | 5/1993 |
| JP | 09-136231 | A | 5/1997 |
| JP | 2001-287127 | A | 10/2001 |
| JP | 2002-239862 | A | 8/2002 |
| JP | 4950123 | B2 | 6/2012 |

OTHER PUBLICATIONS

Office Action dated Feb. 2, 2016 in Japanese Patent Application No. 2014-33166 (with English translation of pertinent portion).

Office Action dated May 10, 2016 in Japanese Patent Application No. 2014-033166 with English translation of pertinent portion.

International Search Report and Written Opinion of the International Searching Authority dated Oct. 6, 2014, in PCT/JP2014/068969 Filed Jul. 10, 2014.

Office Action dated Jun. 14, 2019 in corresponding Indian Patent Application No. 201647001066 (with English Translation), citing documents AA therein, 5 pages.

* cited by examiner

10

CLAMP APPARATUS

TECHNICAL FIELD

The present invention relates to a clamp apparatus for clamping workpieces on an automated assembly line or the like.

BACKGROUND ART

Heretofore, in an automated assembly line for automobiles, an assembly process has been performed in which clamping is carried out by a clamp apparatus under a condition in which pre-formed frames are positioned in an overlaid manner and the frames are welded together.

In one such clamp apparatus, as disclosed in Japanese Patent No. 4950123, a pair of left and right clamp arms are provided, the clamp arms being disposed for rotation respectively through pins. Further, proximal ends of the clamp arms are supported pivotally via a base to which a drive unit is connected, whereby distal ends of the clamp arms are operated to open and close. Thus, a workpiece such as a frame or the like is gripped from the left and right by the distal ends of the pair of clamp arms.

SUMMARY OF INVENTION

With the aforementioned clamp apparatus, which is installed on an automated assembly line as described above, in general, workpieces of the same shape are clamped by the clamp arms, and with respect to other workpieces of a different shape that are transported on the automated assembly line, a different type of clamp apparatus is prepared, and clamping is performed therewith. However, by providing multiple types of clamp apparatus corresponding to the shapes of the workpieces, installation costs are increased and a large installation space is required.

A general object of the present invention is to provide a clamp apparatus, which is capable of reliably and stably clamping plural types of workpieces having different shapes.

The present invention is characterized by a clamp apparatus in which, by rotation of clamp arms, workpieces are clamped between gripping members of the clamp arms, comprising:

a body;

a drive unit disposed on the body and having displacement bodies that are displaced along an axial direction;

at least two pairs of clamp arms supported rotatably with respect to the body, the clamp arms being arranged face-to-face with each other, wherein distances between the gripping members of the clamp arms when the workpieces are clamped differ in each of the pairs; and a driving force transmission mechanism having pressing members that press ends of the clamp arms, and which is connected to the drive unit and transmits to the clamp arms through the pressing members a driving force along an axial direction of the drive unit, thereby causing rotation of the clamp arms, wherein a plurality of the drive units are provided corresponding to the quantity of the clamp arms, the clamp arms being driven independently, respectively, by the plural drive units.

According to the present invention, in the clamp apparatus, at least two pairs of clamp arms are provided, which are supported rotatably with respect to the body, the clamp arms being arranged face-to-face with each other, and wherein distances between the gripping members of the clamp arms when the workpieces are clamped differ in each of the pairs. In addition, a plurality of the drive units corresponding to the quantity of the clamp arms are driven respectively and independently, such that, by the pressing members of the driving force transmission mechanism, a driving force is transmitted selectively to any one of the at least two pairs of clamp arms, whereby the clamp arms of one pair are rotated and the workpiece is clamped by the gripping members.

Consequently, among the at least two pairs of clamp arms, a drive unit corresponding to clamp arms having a distance between the gripping members thereof that corresponds to the shape (width dimension) of the workpiece is driven selectively to transmit a driving force to the clamp arms and rotate the same. Thus, with a single clamp apparatus, a plurality of types of workpieces that differ in shape can be clamped stably and reliably. As a result, for example, compared to a situation in which different clamp apparatus are prepared respectively for each of differently shaped workpieces, installation costs can be reduced. In addition, since the space for installation of plural types of clamp apparatus for gripping different workpieces can be reduced, it is possible to contribute to space savings on an automated assembly line.

DESCRIPTION OF EMBODIMENTS

Figure 1:
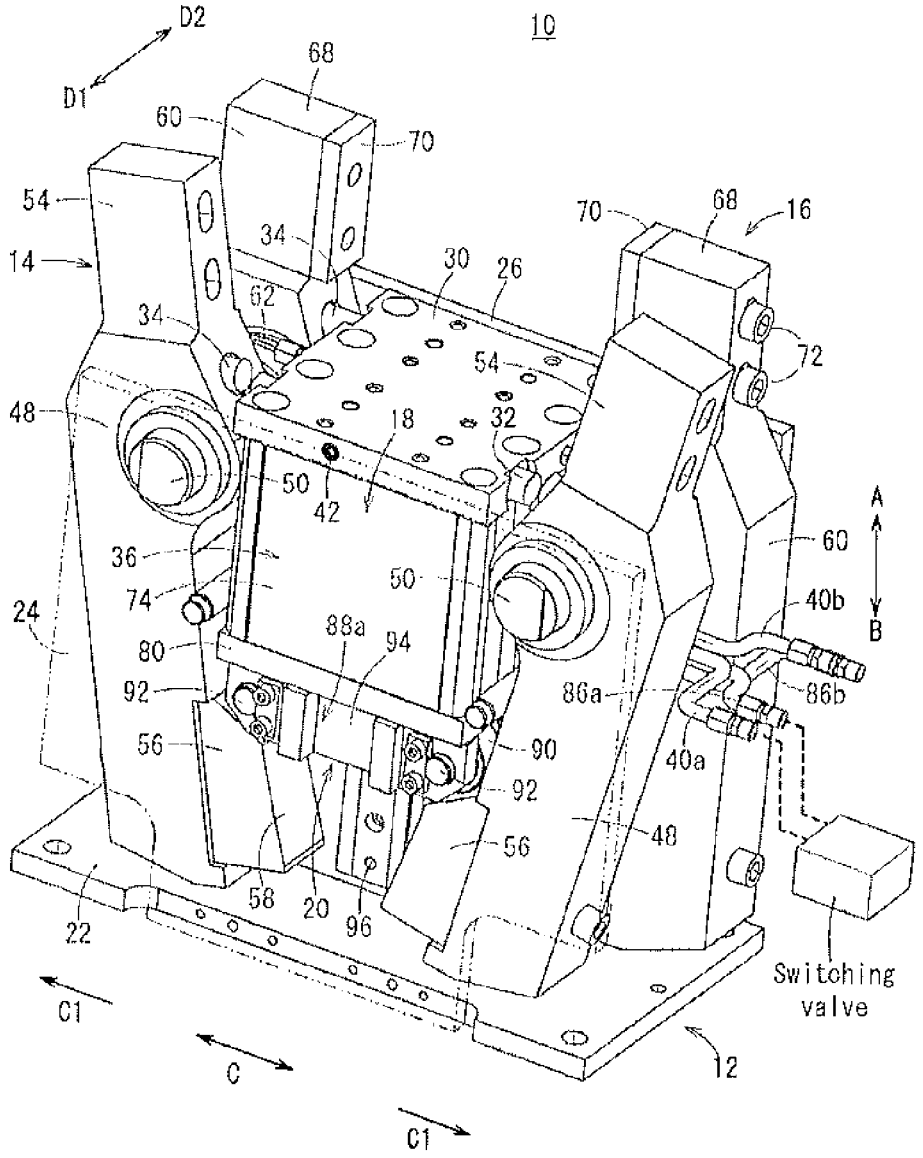
FIG. 1 is an external perspective view with partial omission of a clamp apparatus according to a first embodiment of the present invention.
Figure 2:
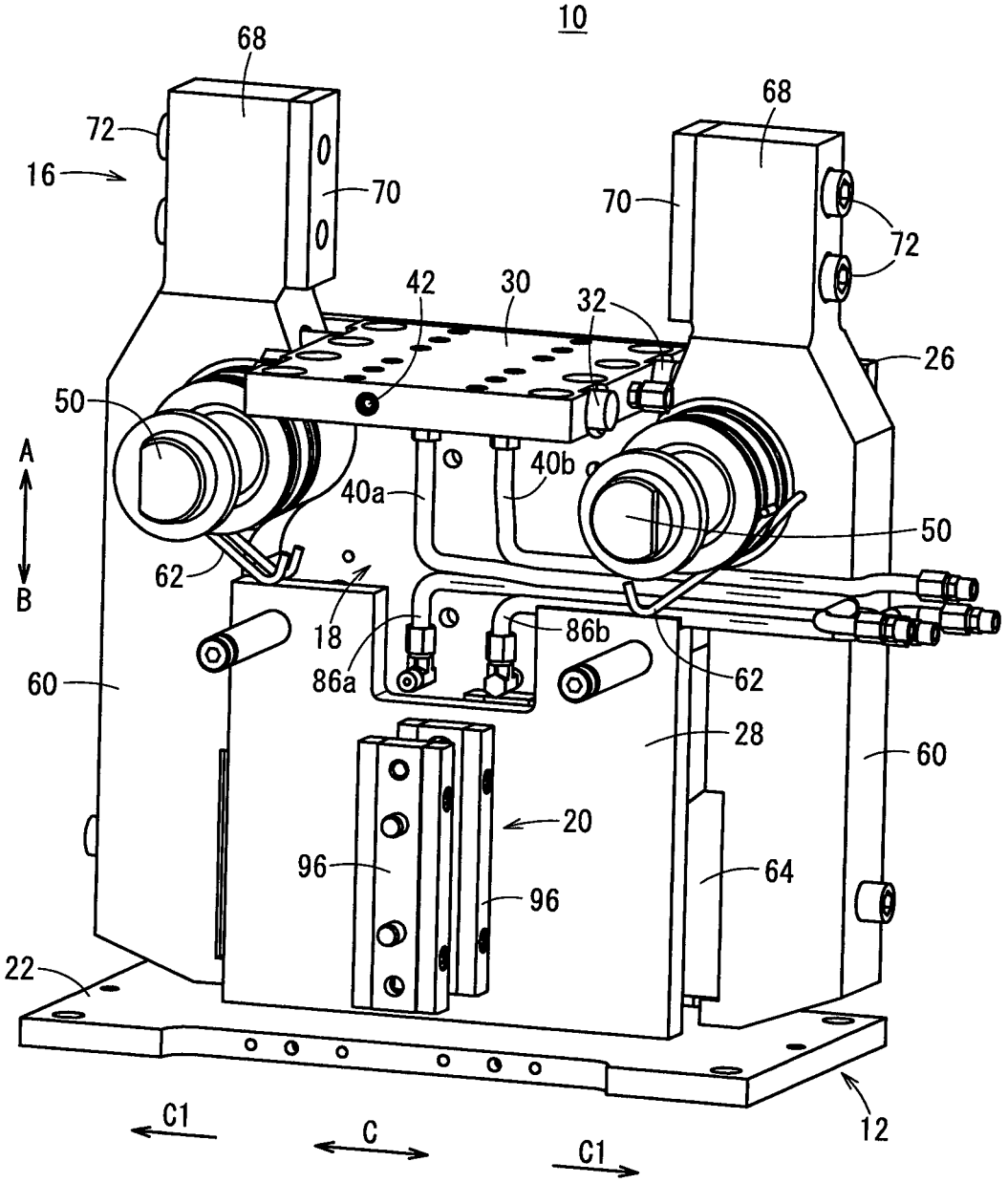
FIG. 2 is an external perspective view showing a condition in which first clamp arms and a first cylinder are removed from the clamp apparatus shown in FIG. 1.
Figure 3:
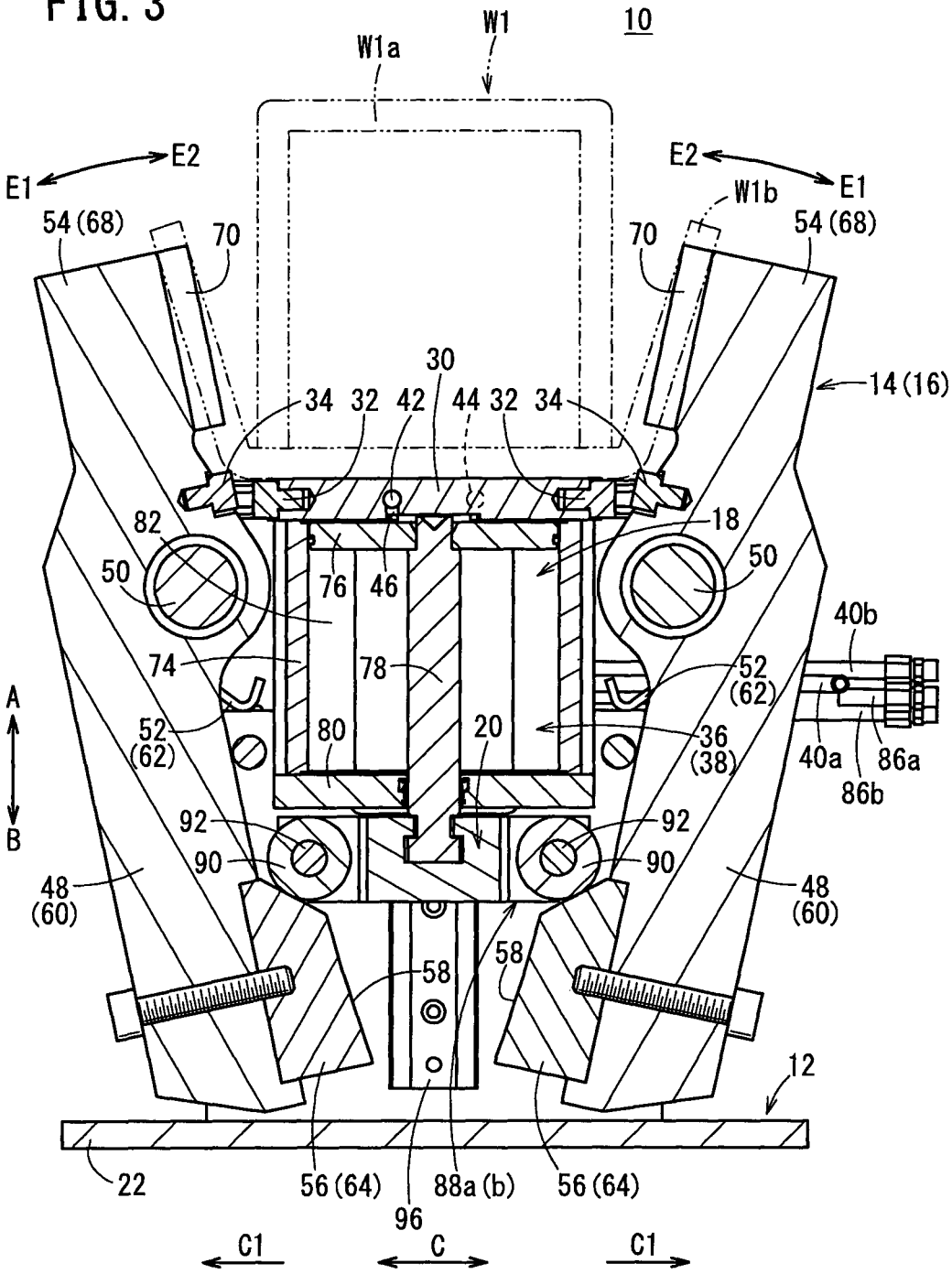
FIG. 3 is an overall cross sectional view showing an unclamped state of the clamp apparatus shown in FIG. 1.

As shown in FIGS. 1 through 3, a clamp apparatus 10 includes a body 12, first and second clamp arms 14, 16 supported rotatably with respect to the body 12, drive units 18 fixed to the body 12, and driving force transmission mechanisms 20 that transmit driving forces of the drive units 18 respectively to the first and second clamp arms 14, 16.

The body 12, for example, is made up from a base 22, which is formed in a planar shape and is arranged in a horizontal direction, a pair of first and second plate bodies 24, 26 connected respectively to both side surfaces of the base 22, and which are separated mutually by a predetermined distance, and an intermediate plate body 28 disposed between the first plate body 24 and the second plate body 26 (see FIG. 2).

The first and second plate bodies 24, 26 and the intermediate plate body 28 are formed at predetermined heights in an upward direction (the direction of the arrow A) perpendicular to the base 22. The intermediate plate body 28 is lower than the first and second plate bodies 24, 26, and is disposed at a center position between the first plate body 24 and the second plate body 26 (see FIG. 2).

Further, the base 22, for example, is mounted on a floor surface, such that the clamp apparatus 10 is fixed in a given location by fixing the base 22 to the floor surface through non-illustrated bolts or the like.

On the other hand, at an upper portion of the body 12, a ceiling portion 30 is connected to upper end parts of the first and second plate bodies 24, 26. The ceiling portion 30 is arranged perpendicularly with respect to a direction of extension (the direction of arrows A and B) of the first and second plate bodies 24, 26, and is disposed on the body 12 substantially centrally in the widthwise direction (the direction of the arrow C) thereof. Stated otherwise, the ceiling portion 30 is disposed substantially in parallel with the base 22.

On the ceiling portion 30, stoppers 32 are provided, respectively, on side surfaces thereof that face the later-described first and second clamp arms 14, 16, and which abut against positioning members 34 that are disposed on the first and second clamp arms 14, 16. In addition, the workpiece is placed on an upper surface of the ceiling portion 30 when the workpiece (refer to W1 in FIG. 3) is gripped by the clamp apparatus 10.

Further, first and second cylinders 36, 38 that constitute the drive units 18 are connected to a lower surface of the ceiling portion 30. The first and second cylinders 36, 38 are disposed to extend in a vertical downward direction (in the direction of the arrow B) perpendicular to the ceiling portion 30. Additionally, as shown in FIG. 4, the first cylinder 36 is arranged on the side of the first plate body 24 (in the direction of the arrow D1), and the second cylinder 38 is arranged substantially parallel thereto on the side of the second plate body 26 (in the direction of the arrow D2).

Figure 4:
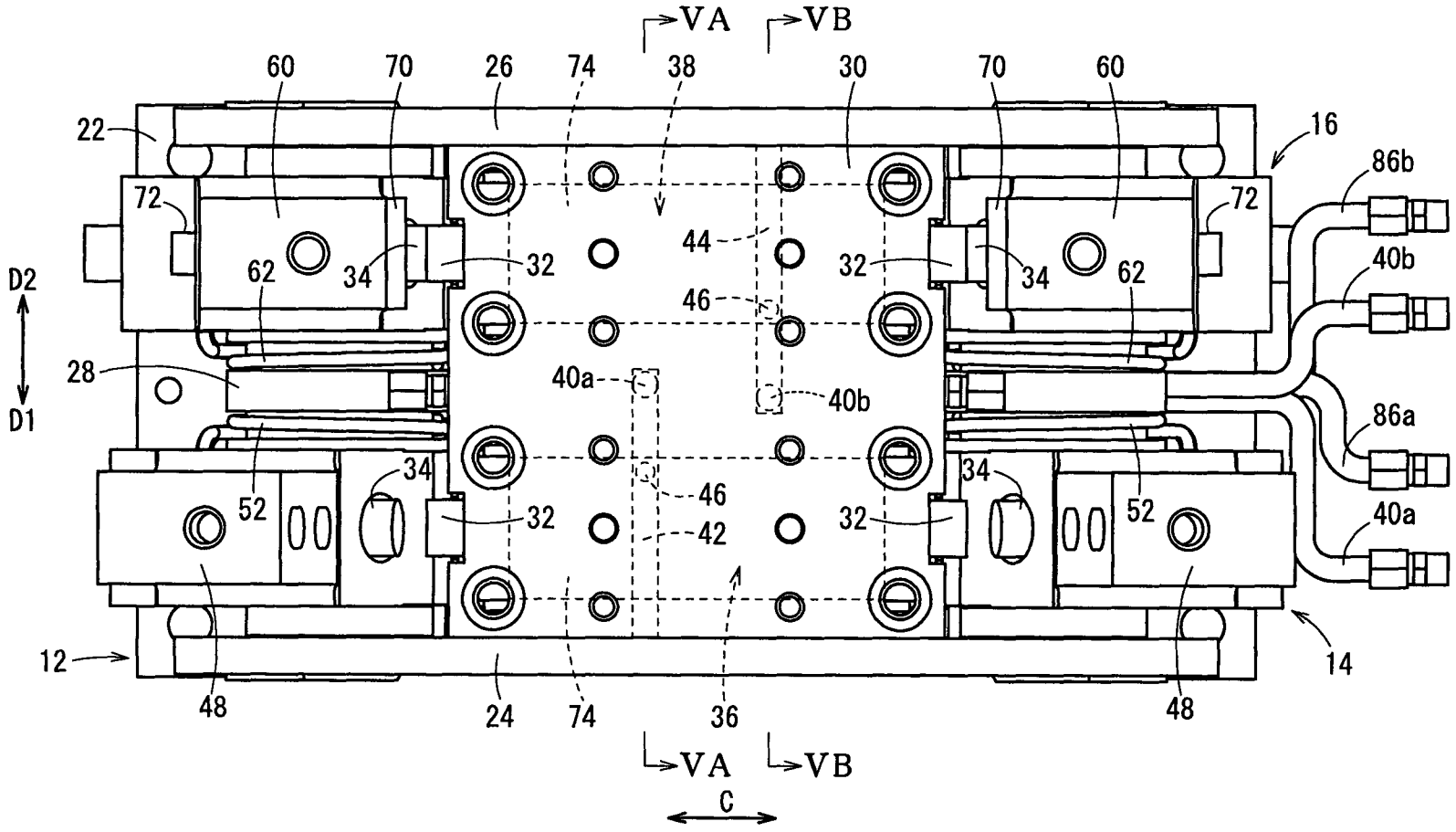
FIG. 4 is a top plan view of the clamp apparatus of FIG. 1.

Furthermore, a pair of first pipes 40*a*, 40*b*, which are connected to a non-illustrated pressure fluid supply source, are connected respectively to the ceiling portion 30 (see FIGS. 2 and 4). In addition, as shown in FIG. 4, ends of the first pipes 40*a*, 40*b* communicate respectively with first and second passages 42, 44 that are formed in the interior of the ceiling portion 30.

The first passage 42 extends in a straight line toward a side of the second plate body 26 (in the direction of the arrow D2) from one side surface of the ceiling portion 30 facing the first plate body 24. The first pipe 40*a* is connected to the distal end of the first passage 42, and a communication hole 46, which opens in a substantially central portion along the longitudinal direction, communicates with the interior of the first cylinder 36.

The second passage 44 extends in a straight line toward a side of the first plate body 24 (in the direction of the arrow D1) from the other side surface of the ceiling portion 30 facing the second plate body 26. The first pipe 40*b* is connected to the distal end of the second passage 44, and a communication hole 46, which opens in a substantially central portion along the longitudinal direction, communicates with the interior of the second cylinder 38.

In addition, a pressure fluid, which is supplied to the first pipes 40*a*, 40*b*, is supplied through the first and second passages 42, 44 and the communication holes 46 to sides on one side of the first and second cylinders 36, 38 (in the direction of the arrow A).

Moreover, the first passage 42 and the second passage 44 are formed substantially in parallel and are separated a predetermined distance in the widthwise direction (the direction of the arrow C) of the ceiling portion 30.

The first clamp arms 14, as shown in FIGS. 1 and 3, for example, are made up from a pair of substantially symmetrical first arm portions 48, which are arranged symmetrically in the widthwise direction (the direction of the arrow C) with respect to the center of the body 12 about an axis of the later-described drive unit 18. In addition, the pair of first arm portions 48 are disposed substantially in parallel proximate the side of the first plate body 24 (in the direction of the arrow D1) between the first plate body 24 and the second plate body 26 (see FIG. 4).

Additionally, a pair of arm pins 50 are inserted, respectively, substantially in the center along the longitudinal direction of the first arm portions 48. Opposite ends of the arm pins 50 are axially supported on the first and second plate bodies 24, 26, whereby the first arm portions 48 are rotatably supported, respectively, with respect to the body 12. Further, the arm pins 50 are inserted respectively through a pair of first springs 52, one ends of which are engaged respectively with an upper portion of the intermediate plate body 28, and other ends of which are engaged respectively with the first clamp arms 14.

For this reason, by a spring force of the first springs 52, the first clamp arms 14 are biased to rotate in directions (the directions of the arrows E1) about the arm pins 50, so that the first gripping members 54 separate mutually away from each other.

Stated otherwise, the first springs 52 press the other end sides of the first clamp arms 14 in widthwise outside directions (the directions of the arrows C1) of the body 12, whereby the first gripping members 54 are biased to rotate about the arm pins 50 in directions (the directions of the arrows E1 in FIG. 3) to separate away from each other and to bring about an unclamped state.

Further, a pair of first cam members 56 are installed on mutually facing side surfaces in one end portions (ends), which are arranged on the side of the base 22 (in the direction of the arrow B) of the first arm portions 48.

The first cam members 56 are formed in block-like shapes, and are installed in recesses formed on side surfaces on the ends of the first arm portions 48. Cam surfaces 58 are provided on the first cam members 56, which are inclined at predetermined angles, so that the first cam members 56 gradually widen toward the one end side (in the direction of the arrow B) of the first arm portions 48.

On the pair of first arm portions 48, one of the first cam members 56 and the other of the first cam members 56 are arranged substantially symmetrically, sandwiching the drive unit 18 (first cylinder 36) therebetween, so that the respective cam surfaces 58 confront one another mutually (see FIG. 3).

On the other hand, the first gripping members 54 for clamping the first workpiece W1 are formed on the other ends of the first arm portions 48. The first gripping members 54 have gripping surfaces, which face each other, are substantially rectangular in cross section, and are formed with vertical surfaces that lie substantially in parallel with the longitudinal direction of the first arm portions 48.

The second clamp arms 16, as shown in FIGS. 1 and 3, for example, are made up from a pair of substantially symmetrical second arm portions 60, which are arranged symmetrically in the widthwise direction (the direction of the arrow C) with respect to the center of the body 12.

In addition, the pair of second arm portions 60 are disposed substantially in parallel proximate the side of the second plate body 26 (in the direction of the arrow D2 in FIG. 4) between the first plate body 24 and the second plate body 26. Between the first and second plate bodies 24, 26, the second clamp arms 16 are disposed substantially in parallel, and are separated a predetermined distance from the first clamp arms 14.

The pair of arm pins 50 are inserted, respectively, substantially in the center along the longitudinal direction of the second arm portions 60, at positions on the other end sides (in the direction of the arrow A) thereof. Opposite ends of the arm pins 50 are axially supported on the first and second plate bodies 24, 26, whereby the second arm portions 60 are rotatably supported, respectively, with respect to the body 12. Further, the arm pins 50 are inserted respectively through a pair of second springs 62, one ends of which are engaged respectively with an upper portion of the intermediate plate body 28, and other ends of which are engaged respectively with the second clamp arms 16. For this reason, by the spring force of the second springs 62, the second clamp arms 16 are biased to rotate in directions (the directions of the arrows E1) about the arm pins 50, so that the second gripping members 68 separate mutually away from each other.

Stated otherwise, the second springs 62 press the other end sides of the second clamp arms 16 in widthwise outside directions (the directions of the arrows C1) of the body 12, whereby the second gripping members 68 are biased to rotate about the arm pins 50 in directions (the directions of the arrows E1 in FIG. 3) to separate away from each other and to bring about an unclamped state.

The arm pins 50, which are the same as those of the first arm portions 48, are inserted respectively through the second arm portions 60, and the second arm portions 60 are arranged in parallel with the first arm portions 48, and are separated by a predetermined distance therefrom along the axial direction of the arm pins 50.

Moreover, the second arm portions 60 that make up the second clamp arms 16 are formed in substantially the same shape as the first arm portions 48 that make up the first clamp arms 14.

Figure 6:
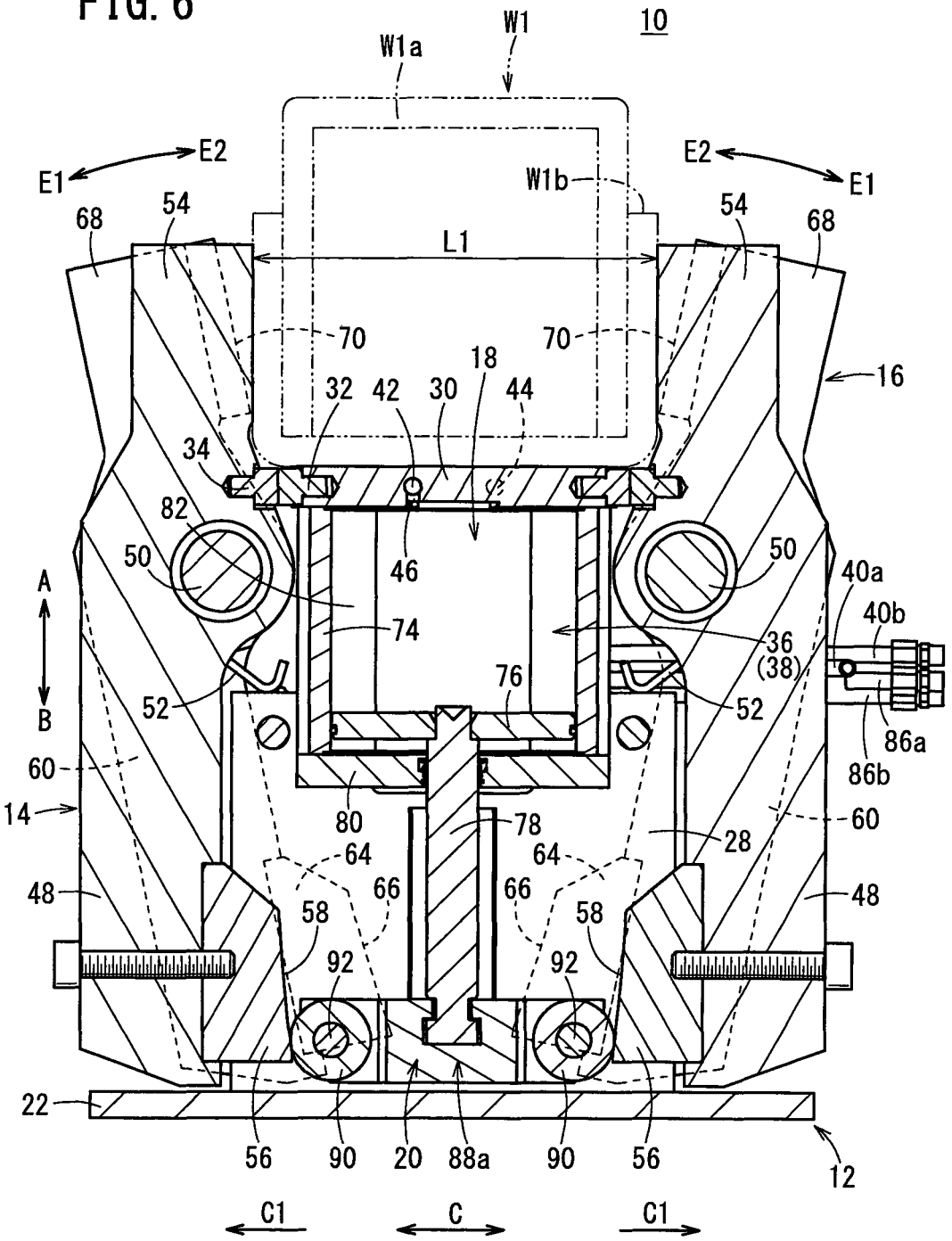
FIG. 6 is an overall cross sectional view showing a clamped state of a first workpiece by first clamp arms, in the clamp apparatus of FIG. 3.

Further, a pair of second cam members 64 are installed on mutually facing side surfaces in one end portions (ends), which are arranged on the side of the base 22 (in the direction of the arrow B) of the second arm portions 60. The second cam members 64, as shown in FIG. 6, are formed in block-like shapes having the same shape as the first cam members 56, and are installed in recesses formed on side surfaces on the ends of the second arm portions 60.

Cam surfaces 66 are provided on the second cam members 64, which are inclined at predetermined angles, so that the second cam members 64 gradually widen toward the one end side (in the direction of the arrow B) of the second arm portions 60. In addition, on the pair of second arm portions 60, one of the second cam members 64 and the other of the second cam members 64 are arranged substantially symmetrically, sandwiching the drive unit 18 (second cylinder 38) therebetween, so that the respective cam surfaces 66 confront one another mutually (see FIG. 6).

The first cam members 56 installed on the first clamp arms 14 may be different in shape from the second cam members 64 installed on the second clamp arms 16.

On the other hand, as shown in FIGS. 1 through 3, the second gripping members 68 for clamping the second workpiece W2, which differs in the width dimension from the first workpiece W1 (see FIG. 7), are formed on the other ends of the second arm portions 60. The second gripping members 68 have gripping surfaces, which face to each other, are substantially rectangular in cross section, and are formed with vertical surfaces that lie substantially in parallel with the longitudinal direction of the second clamp arms 16. In addition, attachments 70, which have a predetermined thickness and are formed in plate-like shapes from a metal material, for example, are fixed by bolts 72 to the second gripping members 68.

The attachments 70, for example, have flat surfaces, which lie substantially in parallel with the gripping surfaces, and are capable of gripping the second workpiece W2 by the flat surfaces thereof. Further, the attachments 70 are detachable by rotating the bolts 72 to thereby release the fixed state of the attachments 70.

Furthermore, on the first arm portions 48 and the second arm portions 60, as shown in FIG. 4, positioning members 34 are provided, which project perpendicularly to the longitudinal direction of the first arm portions 48 and the second arm portions 60, respectively, downwardly of the first and second gripping members 54, 68.

Additionally, at a time of clamping when the first gripping members 54 of the first arm portions 48 and the second gripping members 68 of the second arm portions 60 are brought into mutual proximity and made to grip the first and second workpieces W1, W2, the positioning members 34 abut respectively against the stoppers 32 that are provided on the ceiling portion 30. Accordingly, the width dimensions L1, L2 are regulated at a time of clamping when the first and second workpieces W1, W2 are clamped by the first arm portions 48 and the second arm portions 60.

As shown in FIGS. 1 through 4, the drive units 18 are arranged between the first plate body 24 and the second plate body 26, and include the first and second cylinders 36, 38, which are connected with respect to a lower surface of the ceiling portion 30. The first and second cylinders 36, 38 extend in a vertical downward direction (in the direction of the arrow B) toward the base 22.

As shown in FIGS. 3 and 6, the first and second cylinders 36, 38 are of the same structure, each of which includes, respectively, a tubular cylinder tube 74, a piston 76 disposed displaceably in the interior of the cylinder tube 74, a piston rod 78 connected to the piston 76, and a rod cover 80 disposed in an opening of the cylinder tube 74 and that displaceably supports the piston rod 78.

The rod covers 80, which are disposed on the other end sides of the first and second cylinders 36, 38, are oriented downwardly (in the direction of the arrow B).

The cylinder tubes 74 are fixed by non-illustrated bolts with respect to the ceiling portion 30 in an erect manner, and are oriented in a vertical downward direction (the direction of the arrow B). The cylinder tubes 74 include cylinder holes 82 in the interior thereof that extend along an axial direction (the direction of arrows A and B).

Figure 5B:
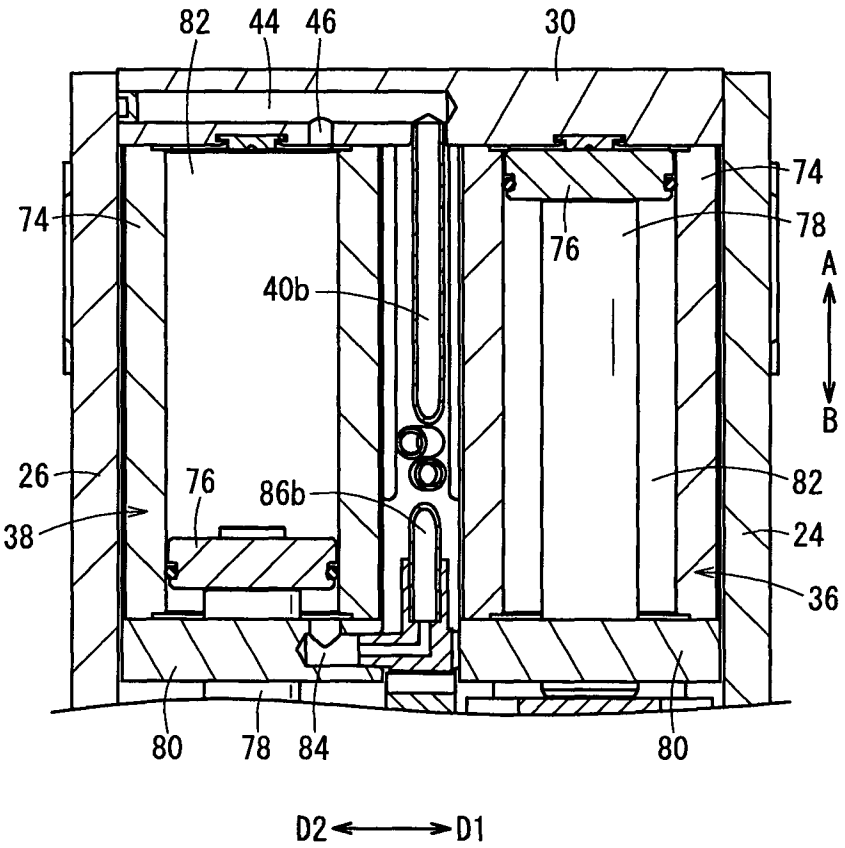
FIG. 5B is a cross sectional view taken along line VB-VB of FIG. 4.

Further, upper end portions of the cylinder tubes 74 are closed by the ceiling portion 30, and as shown in FIGS. 4 through 5B, the cylinder holes 82 thereof communicate respectively with the first pipes 40*a*, 40*b* through the first and second passages 42, 44 that are formed in the ceiling portion 30. A pressure fluid is supplied respectively to the cylinder holes 82 through the first pipes 40*a*, 40*b*.

The pistons 76 are formed in disk-like shapes, for example, and outer circumferential surfaces thereof slide along the inner circumferential surfaces of the cylinder holes 82. The piston rods 78 are connected integrally to centers of the pistons 76, and the piston rods 78 extend a predetermined length toward the other end side (in the direction of the arrow B) of the cylinder tubes 74 with respect to the pistons 76.

Figure 5A:
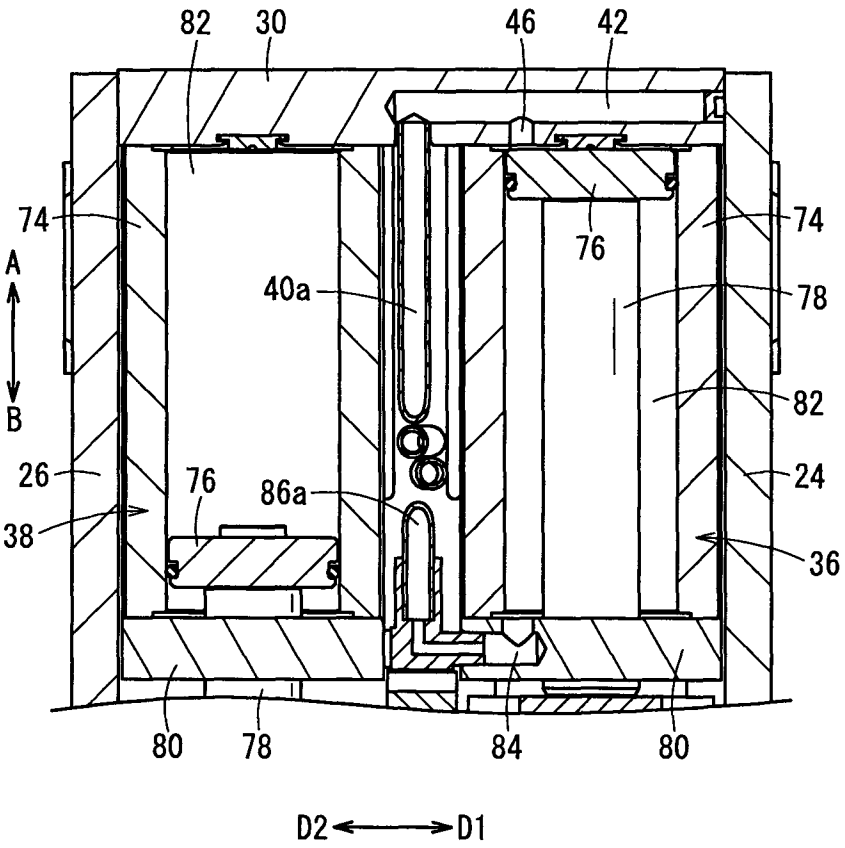
FIG. 5A is a cross sectional view taken along line VA-VA of FIG. 4.

The piston rods 78 are inserted through rod holes of the rod covers 80, which are installed so as to close the other end sides (in the direction of the arrow B) of the cylinder tubes 74, such that the piston rods 78 are supported for displacement along the axial direction (the direction of arrows A and B). Further, as shown in FIGS. 5A and 5B, in side surfaces of the rod covers 80, fluid ports 84 are formed respectively that penetrate perpendicularly to the axial direction (the direction of arrows A and B) of the cylinder tube 74. Second pipes 86*a*, 86*b*, which are connected to the non-illustrated pressure fluid supply source, are connected respectively to the fluid ports 84.

In addition, the pistons 76 and the piston rods 78 are lowered by supplying pressure fluid from the first pipes 40*a*, 40*b* respectively to the cylinder holes 82 of the first and second cylinders 36, 38 through the first and second passages 42, 44 on the ceiling 30. On the other hand, the pistons 76 and the piston rods 78 are raised by supplying pressure fluid to the fluid ports 84 through the second pipes 86*a*, 86*b*.

More specifically, the first pipes 40*a*, 40*b* and the second pipes 86*a*, 86*b*, which are connected respectively to the non-illustrated pressure fluid supply source, are connected to the first and second cylinders 36, 38, whereby the pressure fluid is supplied selectively to either the one end side (in the direction of the arrow A) or the other end side (in the direction of the arrow B) of the cylinder tubes 74 under a switching action of a non-illustrated switching device.

As shown in FIGS. 1 through 3, the driving force transmission mechanisms 20 include block bodies 88*a*, 88*b*, which are connected respectively to the other ends of the piston rods 78 of the first and second cylinders 36, 38, pairs of rollers (pressing members) 90, which are supported pivotally in the vicinity of opposite ends of the block bodies 88*a*, 88*b*, and pairs of roller pins 92 that pivotally support the rollers 90, respectively.

Figure 7:
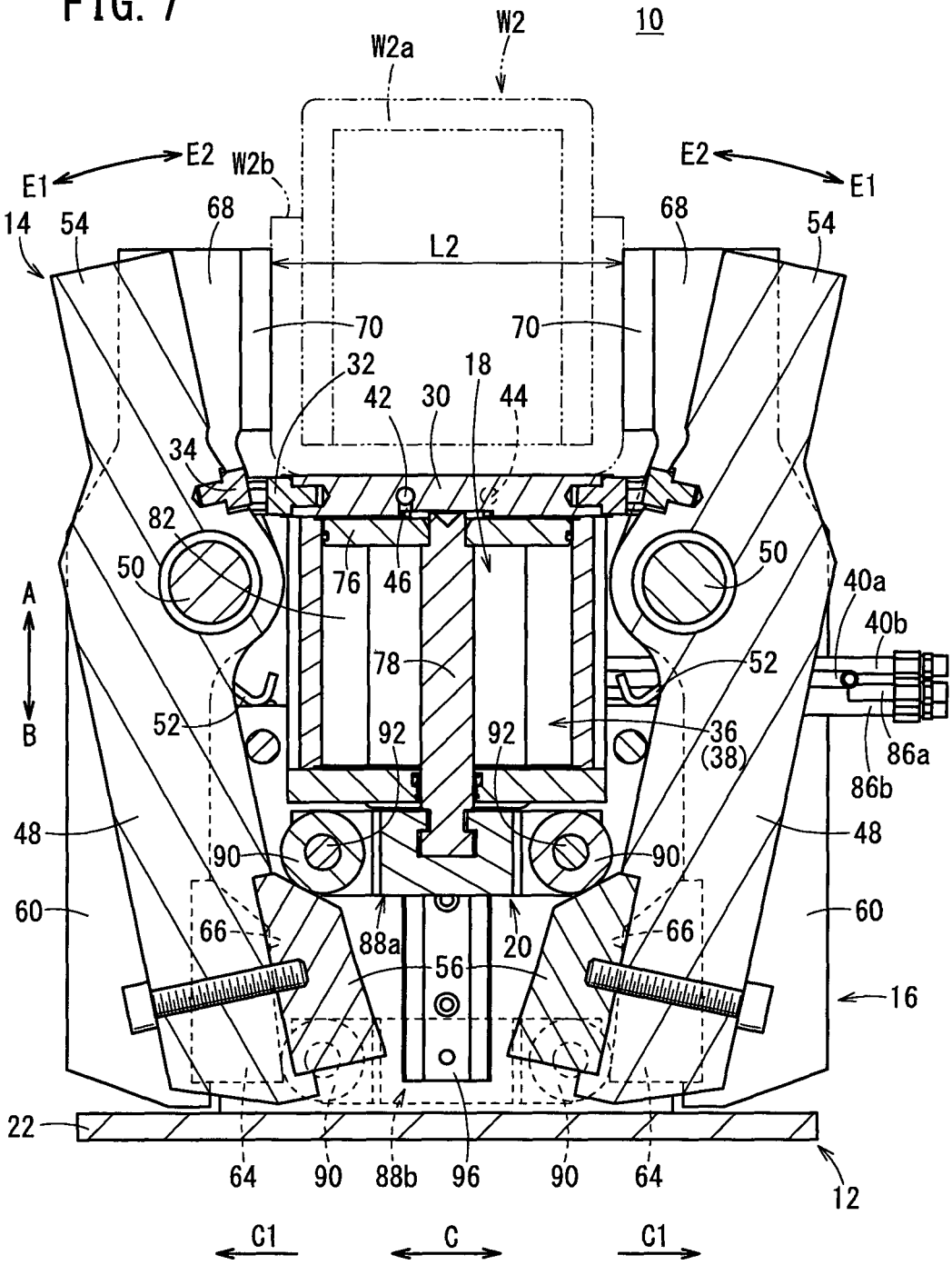
FIG. 7 is an overall cross sectional view showing a clamped state of a second workpiece by second clamp arms, in the clamp apparatus of FIG. 3.

In addition, as shown in FIG. 3, the block body 88*a*, which is connected to the first cylinder 36, is arranged in facing relation to ends of the first clamp arms 14, whereas the block body 88*b*, which is connected to the second cylinder 38, is arranged in facing relation to ends of the second clamp arms 16 as shown in FIG. 7.

The block bodies 88*a*, 88*b*, for example, extend in a direction (the direction of arrow C) perpendicular to the axial direction (the direction of arrows A and B) of the piston rods 78, and in center portions thereof, shafts (not shown) are formed that are connected to the piston rods 78. Ends of the shafts are engaged with grooves in the block bodies 88*a*, 88*b*, so that the block bodies 88*a*, 88*b* are connected perpendicularly with respect to the axial direction of the piston rods 78, and are displaced integrally with the piston rods 78.

Further, a pair of vertically extending guide grooves 94 (see FIG. 1) are formed respectively on opposite side surfaces of the block bodies 88*a*, 88*b* facing toward the intermediate plate body 28 and the first and second plate bodies 24, 26. Guide rails 96, which are installed on the intermediate plate body 28 and the first and second plate bodies 24, 26, are inserted respectively into the recessed guide grooves 94, which have rectangular shapes in cross section (see FIGS. 1 through 3). Consequently, when displaced together with the piston rods 78, the block bodies 88*a*, 88*b* are guided in the vertical direction (the direction of arrows A and B) by the guide rails 96.

Furthermore, the block bodies 88*a*, 88*b* have predetermined widths in the horizontal direction (the direction of the arrow C) perpendicular to the axial direction of the drive units 18, opposite ends thereof being formed at equal distances about the axial lines of the piston rods 78. Pairs of roller pins 92 are supported on the opposite ends, and pairs of rollers 90 are supported rotatably via the roller pins 92.

The rollers 90 are disposed on the block bodies 88*a*, 88*b* at positions face-to-face with the first and second clamp arms 14, 16, and project toward the one end sides (in the direction of the arrow B) of the first and second arm portions 48, 60, coming into abutment respectively against the first cam members 56 and the second cam members 64.

In addition, by lowering of the block bodies 88*a*, 88*b* under a driving action of the drive units 18, the rollers 90 are rotated in a state of abutment against the cam surfaces 58, 66 of the first and second cam members 56, 64, and via the cam surfaces 58, 66, the ends of the first and second clamp arms 14, 16 are pressed by predetermined pressing forces in directions (the directions of the arrows C1) to separate mutually away from one another.

Consequently, the first and second arm portions 48, 60 are rotated in directions such that the first and second gripping members 54, 68 approach one another mutually (in the directions of the arrows E2 in FIG. 3) in opposition to the spring forces of the first and second springs 52, 62 that bias the one end sides thereof inwardly in the widthwise direction.

On the other hand, by the block bodies 88*a*, 88*b* being raised, the pressing forces applied by the rollers 90 to the first and second cam members 56, 64 in widthwise outside directions (the directions of the arrows C1) are extinguished. Therefore, by the spring forces of the first and second springs 52, 62, the first and second clamp arms 14, 16 are rotated respectively in directions (the directions of the arrows E1 in FIG. 3) to separate the first and second gripping members 54, 68 away from each other.

The clamp apparatus 10 according to the first embodiment of the present invention is constructed basically as described above. Next, operations and advantages of the clamp apparatus 10 will be explained. In the following description, the unclamped condition shown in FIG. 3, in which the first and second gripping members 54, 68 of the first and second clamp arms 14, 16 are separated respectively from each other, will be described as an initial position.

At first, the initial position in the unclamped state will be described. In the initial position, as shown in FIG. 3, pressure fluid is not supplied with respect to the first and second cylinders 36, 38 that make up the drive units 18, and a condition is assumed in which the other ends of the first and second clamp arms 14, 16 are biased in directions (the directions of the arrows E1) away from each other by the spring forces of the first and second springs 52, 62. Further, the pistons 76 and the piston rods 78 are raised in a condition such that the rollers 90, which are supported pivotally on the block bodies 88*a*, 88*b*, are separated from the cam surfaces 58, 66 of the first and second cam members 56, 64.

More specifically, the ends of the first and second clamp arms 14, 16 are not pressed outwardly (in the directions of the arrows C1) by the rollers 90, and by the spring forces of the first and second springs 52, 62, the first and second gripping members 54, 68 are rotated in directions (the directions of the arrows E1) to separate mutually away from each other.

Next, a brief description will be given, with reference to FIG. 3, concerning the first workpiece W1 that is gripped by the aforementioned clamp apparatus 10.

The first workpiece W1 is made up, for example, from a first frame W1*a*, which is U-shaped in cross section and constitutes part of the frame of a vehicle, and a second frame W1*b*, which is U-shaped in cross section and is intended for assembly onto the first frame W1*a*.

In a state in which an opening of the first frame W1*a* is oriented downwardly (in the direction of the arrow B), the first frame W1*a* is placed between the first gripping members 54 of the first clamp arms 14. On the other hand, side walls of the second frame W1*b* are formed in an inclined manner, so as to expand gradually outward toward the open side thereof, and the opening is arranged to face upwardly (in the direction of the arrow A).

Additionally, the first frame W1*a* is mounted on the ceiling portion 30, in a state in which the first frame W1*a* is inserted into the interior of the second frame W1*b*.

Stated otherwise, the second frame W1*b* is arranged on the outside of the first frame W1*a*, and the side walls of the second frame W1*b* are inclined in an outwardly expanding manner toward sides of the first clamp arms 14 (in the directions of the arrows C1 in FIG. 3).

Next, a case will be described, with reference to FIGS. 3 and 6, in which the first clamp arms 14 are rotated to clamp a first workpiece W1 having a predetermined width dimension L1 (see FIG. 6).

At first, by supplying a pressure fluid through the first pipe 40*a* with respect to the first cylinder 36 that makes up the drive unit 18, the piston 76 and the piston rod 78 are lowered along the axial direction (in the direction of the arrow B) from the above-described initial position. In this case, the fluid port 84 of the first cylinder 36 shown in FIGS. 5A and 5B is in a state of being open to atmosphere, and pressure fluid is not supplied to the second cylinder 38.

Under the driving action of the first cylinder 36, the block body 88*a* is lowered together with the piston rod 78, and the pair of rollers 90 start to come into contact with the cam surfaces 58 of the first cam members 56. Additionally, by the rollers 90 being lowered along the cam surfaces 58, the one ends of the first clamp arms 14 are pressed through the first cam members 56 and separate mutually away from each other (in the directions of the arrows C1).

Consequently, in opposition to the spring force of the first springs 52, which is imparted to the other ends of the first clamp arms 14, the first clamp arms 14 begin to rotate about the arm pins 50 in directions (the directions of the arrows E2) such that the first gripping members 54 approach one another, whereupon the pressing force applied to the cam surfaces 58 from the rollers 90 becomes substantially constant. Therefore, the first arm portions 48 of the first clamp arms 14 are rotated at a substantially constant rotational force, and the second frame W1*b* starts to be clamped by the first gripping members 54.

In addition, by further lowering of the block body 88*a* under the driving action of the drive unit 18, the one ends of the first clamp arms 14 are pressed with a greater force in directions (the directions of the arrows C1) to separate away from each other, accompanied by the first gripping members 54 of the first clamp arms 14 being rotated about the arm pins 50 at a greater force in directions to further approach one another mutually. The first gripping members 54 press the side walls of the second frame W1*b* in directions such that the side walls approach one another, i.e., are pressed and deformed toward the sides of the first frame W1*a* (in the directions of the arrows E2).

As shown in FIG. 6, the positioning members 34 provided on the first clamp arms 14 come into abutment respectively against the stoppers 32, whereupon the side walls of the second frame W1*b*, which are pressed by the first clamp arms 14, abut against the side walls of the first frame W1*a*, and a clamped state is brought about in which clamping of the first workpiece W1 is completed with the side walls thereof being substantially parallel.

At this time, since pressure fluid is not supplied to the second cylinder 38, the second clamp arms 16 are maintained in the unclamped state, and are not rotated from the initial position shown in FIG. 3.

In addition, in a state in which the first and second frames W1*a*, W1*b* are clamped by the first clamp arms 14, the side walls of the first and second frames W1*a*, W1*b* are welded together, for example, using a non-illustrated welding device.

In the foregoing manner, by lowering the block body 88*a* of the driving force transmission mechanism 20 under a driving action of the first cylinder 36 that makes up the drive unit 18, the first cam members 56 are pressed by the pair of rollers 90, and the one ends of the first clamp arms 14 are pressed at a substantially constant force in directions (the directions of the arrows C1) to separate mutually away from each other. Consequently, since the first clamp arms 14 can be rotated about the arm pins 50, the first workpiece W1 can be clamped with a predetermined clamping force.

On the other hand, in the event that the clamped state of the first workpiece W1 by the first clamp arms 14 is to be released, under a switching action of a switching valve, the pressure fluid, which had been supplied from the first pipe 40*a* to the first cylinder 36, is supplied instead from the second pipe 86*a* to the fluid port 84. Consequently, upon being pressed by the pressure fluid, the piston 76 is raised, accompanied by the piston rod 78 and the block body 88*a* being raised integrally therewith.

In addition, by abutment at the end of the piston rod 78, elevation of the piston 76 is stopped, and the block body 88*a* is restored to a position of being separated from the cam surfaces 58 of the first cam members 56. Consequently, the pressing force applied to the one end sides of the first clamp arms 14 is extinguished, and under the spring force of the first springs 52, the first gripping members 54 are rotated in directions away from each other to thereby bring about the unclamped state shown in FIG. 3.

Next, a case will be described, with reference to FIGS. 3 and 7, in which the second clamp arms 16 are rotated to clamp a second workpiece W2 having a width dimension L2 which is narrower than the width dimension of the aforementioned first workpiece W1. Since the attachments 70 are mounted on the second gripping members 68 of the second clamp arms 16, a workpiece (second workpiece W2), which is narrower with respect to the first clamp arms 14 by a width portion corresponding to the widths of the attachments 70, can be clamped.

At first, by supplying a pressure fluid through the first pipe 40*b* with respect to the second cylinder 38 that makes up the drive unit 18, the piston 76 and the piston rod 78 are lowered along the axial direction (in the direction of the arrow B) from the above-described initial position. In this case, the fluid port 84 of the second cylinder 38 is in a state of being open to atmosphere, and pressure fluid is not supplied to the first cylinder 36.

Under the driving action of the second cylinder 38, the block body 88*b* is lowered together with the piston rod 78, and the pair of rollers 90 start to come into contact with the cam surfaces 66 of the second cam members 64. Additionally, by the rollers 90 being lowered along the cam surfaces 66, the one ends of the second clamp arms 16 are pressed through the second cam members 64 and separate mutually away from each other (in the directions of the arrows C1).

Consequently, in opposition to the spring force of the second springs 62, which is imparted to the other ends of the second clamp arms 16, the second clamp arms 16 begin to rotate about the arm pins 50 in directions (the directions of the arrows E2) such that the second gripping members 68 approach one another, whereupon the pressing force applied to the cam surfaces 66 from the rollers 90 becomes substantially constant. Therefore, the second clamp arms 16 are rotated at a substantially constant rotational force, and the second frame W2*b* starts to be clamped.

Additionally, by the block body 88*b* being lowered further upon driving of the second cylinder 38, the rollers 90 are shifted to the cam surfaces 66, and via the second cam members 64, the one ends of the second clamp arms 16 are pressed by a greater force in directions (the directions of the arrows C1) to separate mutually away from each other. Along therewith, the second gripping members 68 of the second clamp arms 16 are rotated at a greater force about the arm pins 50 in directions to approach one another.

Consequently, the second gripping members 68, by way of the attachments 70, press the side walls of the second frame W2*b* in directions such that the side walls approach one another, i.e., are pressed and deformed toward the sides of the first frame W2*a* (in the directions of the arrows E2). In addition, as shown in FIG. 7, the positioning members 34 provided on the second clamp arms 16 come into abutment respectively against the stoppers 32, whereupon the side walls of the second frame W2*b*, which are pressed by the second clamp arms 16, abut against the side walls of the first frame W2*a*, and a clamped state is brought about in which clamping of the second workpiece W2 is completed with the side walls thereof being substantially parallel.

At this time, since pressure fluid is not supplied to the first cylinder 36, the first clamp arms 14 are maintained in the unclamped state, and are not rotated from the initial position shown in FIG. 3.

In addition, in a state in which the first and second frames W2*a*, W2*b* are clamped by the second clamp arms 16, the side walls of the first and second frames W2*a*, W2*b* are welded together, for example, using a non-illustrated welding device.

In the foregoing manner, by lowering the block body 88*b* of the driving force transmission mechanism 20 under a driving action of the second cylinder 38 that makes up the drive unit 18, the second cam members 64 are pressed by the pair of rollers 90, and the one ends of the second clamp arms 16 are pressed at a substantially constant force in directions (the directions of the arrows C1) to separate mutually away from each other. As a result, the second arm portions 60 of the second clamp arms 16 are rotated about the arm pins 50, and the second workpiece W2, which is of a different width dimension than the first workpiece W1, can be clamped with a predetermined clamping force via the attachments 70 that are installed on the second gripping members 68.

Concerning the case in which the clamped state of the second workpiece W2 by the second clamp arms 16 is released, since it is substantially the same as the case in which the clamped state of the first workpiece W1 by the first clamp arms 14 is released, detailed description thereof is omitted.

As described above, according to the first embodiment, in a clamp apparatus 10 having two pairs of first and second clamp arms 14, 16, first and second cylinders 36, 38 are provided in the drive units 18, which are capable of driving the first and second clamp arms 14, 16 independently and respectively. By selectively driving the first and second cylinders 36, 38, and under driving actions of the drive units 18 causing the rollers 90 on the block bodies 88*a*, 88*b* to be brought into abutment against the first and second cam members 56, 64 provided on the first and second clamp arms 14, 16, thereby pressing the first and second cam members 56, 64 in widthwise outside directions (the directions of the arrows C1), either one of the first and second clamp arms 14, 16 can be rotated, and workpieces (W1, W2) having desired width dimensions (L1, L2) can be clamped.

Therefore, by selectively rotating the first and second clamp arms 14, 16 having different clamping widths corresponding to the first and second workpieces W1, W2, which have different width dimensions respectively, a plurality of types of workpieces that differ in shape can be clamped stably and reliably by the single clamp apparatus 10. As a result, for example, compared to a situation in which different clamp apparatus 10 are prepared respectively for each of differently shaped workpieces, installation costs can be reduced. In addition, since the space for installation of plural types of clamp apparatus 10 for gripping different workpieces can be reduced, it is possible to contribute to space savings on an automated assembly line.

Further, the attachments 70, which are mounted on the second gripping members 68 of the second clamp arms 16, are disposed detachably through the bolts 72. Therefore, for example, corresponding to the width dimension of the second workpieces W2 that are clamped by the second clamp arms 16, other attachments that differ in shape or width can easily be exchanged to facilitate handling of such workpieces.

With the above-described first embodiment, a case has been described in which the attachments 70 are installed only on the second clamp arms 16. However, the invention is not limited to this feature, and for example, other attachments 70, which differ in width or shape from the attachments 70 installed on the second clamp arms 16, may also be installed on the first gripping members 54 of the first clamp arms 14. Accordingly, workpieces of different dimensions can be clamped selectively by the first clamp arms 14 and the second clamp arms 16, on which attachments 70 having different shapes are installed, respectively. Further, by exchanging the attachments 70, workpieces of various different shapes can easily be handled, and clamping can be carried out with respect to such workpieces.

Furthermore, even without installing the attachments 70 on the first and second gripping members 54, 68, the first and second gripping members 54, 68 may be formed with different width dimensions, respectively, to enable first and second workpieces W1, W2 of different width dimensions to be clamped directly by the first and second gripping members 54, 68.

Further still, in the above-described first embodiment, a structure has been described in which two types of workpieces (W1, W2) that differ in shape can be clamped by two pairs of first and second clamp arms 14, 16. However, insofar as there are at least two pairs or more, the number of clamp arms is not particularly limited. For example, three types of workpieces that differ in shape may be clamped using a configuration in which three pairs of clamp arms are provided, which can be rotated respectively and independently.

Next, a clamp apparatus 100 according to a second embodiment is shown in FIGS. 8 through 14. Constituent elements of the clamp apparatus 100, which are the same as those of the clamp apparatus 10 according to the above-described first embodiment, are designated by the same reference characters, and detailed description of such features is omitted.

The clamp apparatus 100 according to the second embodiment differs from the clamp apparatus 10 according to the first embodiment, in that, for example, if for some reason a situation occurs in which the first clamp arms 14 or the second clamp arms 16 become locked in a state of clamping the first workpiece W1 or the second workpiece W2, and the unclamping operation cannot be accomplished by the first and second springs 52, 62 alone, then in addition to the spring forces of the first and second springs 52, 62, an assist mechanism 102 is provided for assisting the unclamping operation.

Figure 8:
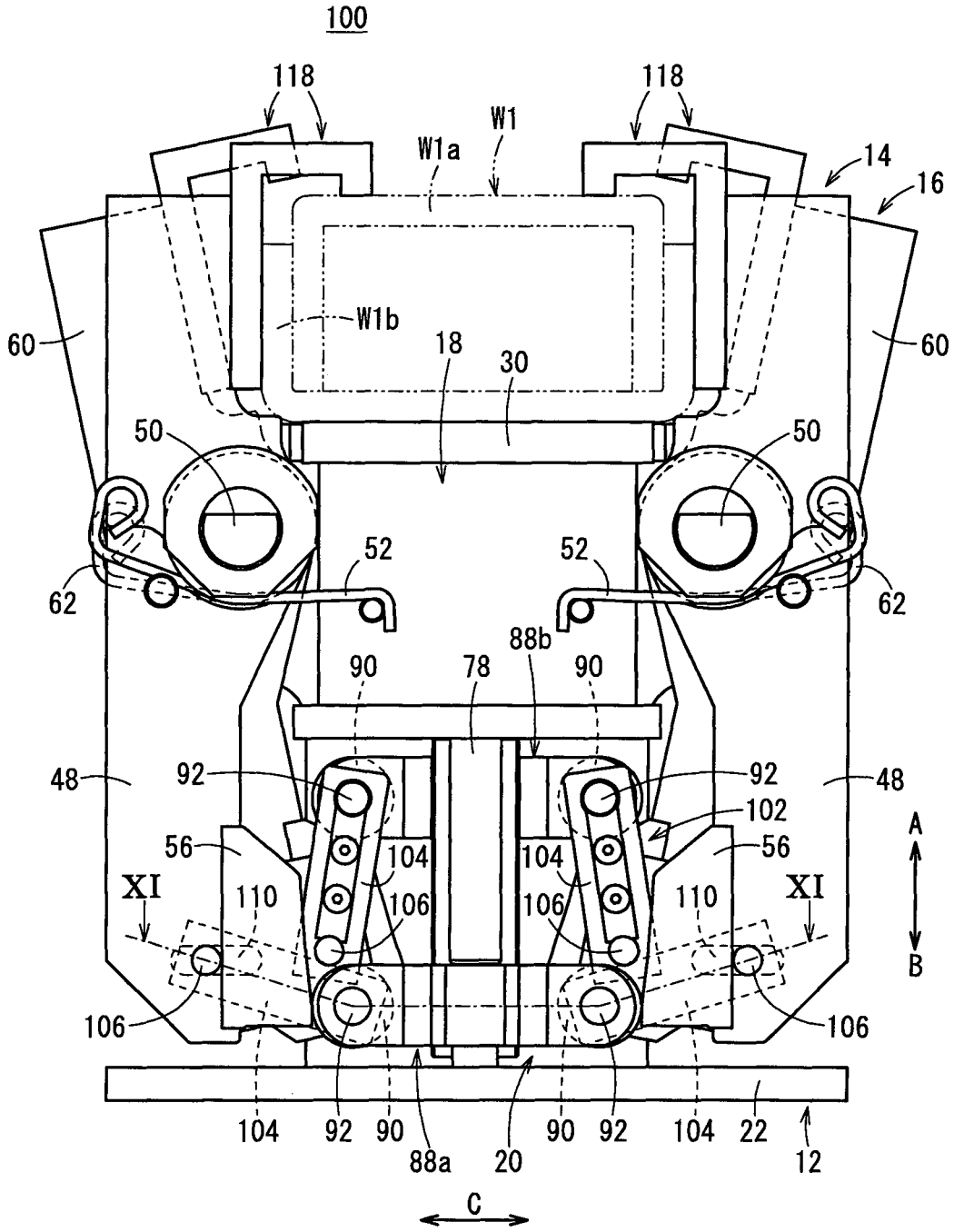
FIG. 8 is a front view with partial omission of a clamp apparatus according to a second embodiment of the present invention.
Figure 9:
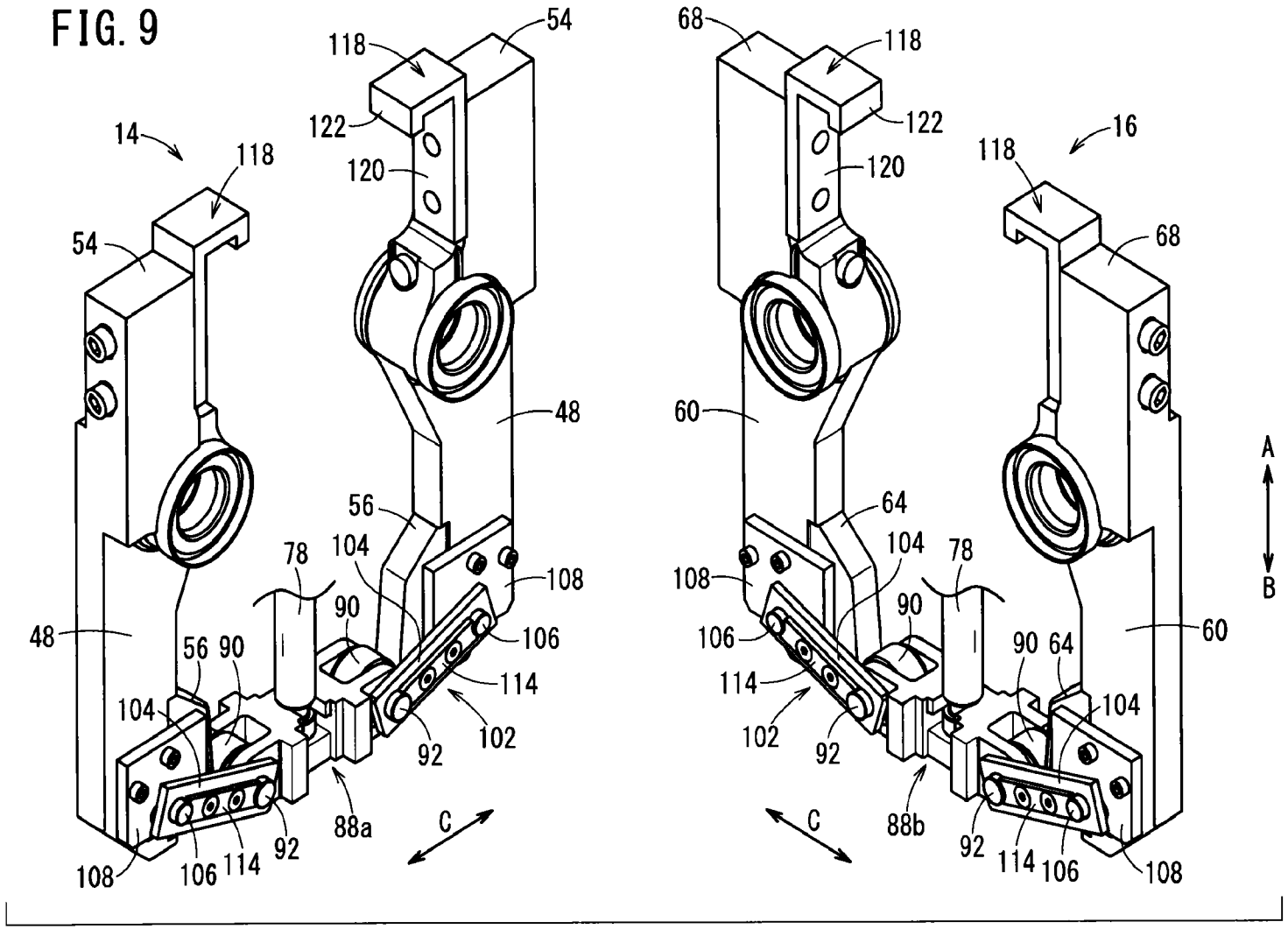
FIG. 9 is an exploded perspective view, developed to show the first clamp arms and the second clamp arms in a mutually separated condition, in the clamp apparatus of FIG. 8.

As shown in FIGS. 8 through 11, assist mechanisms 102 are provided with respect to each of the first clamp arms 14' and the second clamp arms 16, respectively, and are disposed in a connected fashion, respectively, between the one ends of the first and second clamp arms 14, 16 and the block bodies 88*a*, 88*b*. Further, as shown in FIG. 9, the assist mechanisms 102 are disposed, respectively, on an inner side surface of the first clamp arms 14 in facing relation to the second clamp arms 16, and on an inner side surface of the second clamp arms 16 in facing relation to the first clamp arms 14.

Stated otherwise, the assist mechanisms 102 are arranged on the inside of the clamp apparatus 100, such that one of the assist mechanisms 102, which is disposed on the side of the first clamp arms 14, is arranged to mutually face with respect to the other of the assist mechanisms 102, which is disposed on the side of the second clamp arms 16.

Moreover, the assist mechanisms 102 are not limited to being disposed on the clamp apparatus 100 on the inside of the first and second clamp arms 14, 16, and alternatively, may be disposed on side surfaces on outer sides of the first and second clamp arms 14, 16.

In addition, each of the assist mechanisms 102 includes a pair of link plates 104, a pair of link pins 106 disposed on ends of the link plates 104, and a pair of pin grooves 110 formed in brackets 108 that are mounted on the one ends of the first and second clamp arms 14, 16, and in which the link pins 106 are inserted.

The link plates 104, for example, are formed in plate-like shapes having a predetermined length, and are disposed substantially in parallel, respectively, with the first and second clamp arms 14, 16. Additionally, on one end thereof along the lengthwise direction of the link plates 104, the link pins 106 are inserted perpendicularly to the lengthwise direction, whereas ends of the roller pins 92 are inserted through the other end thereof.

Figure 10:
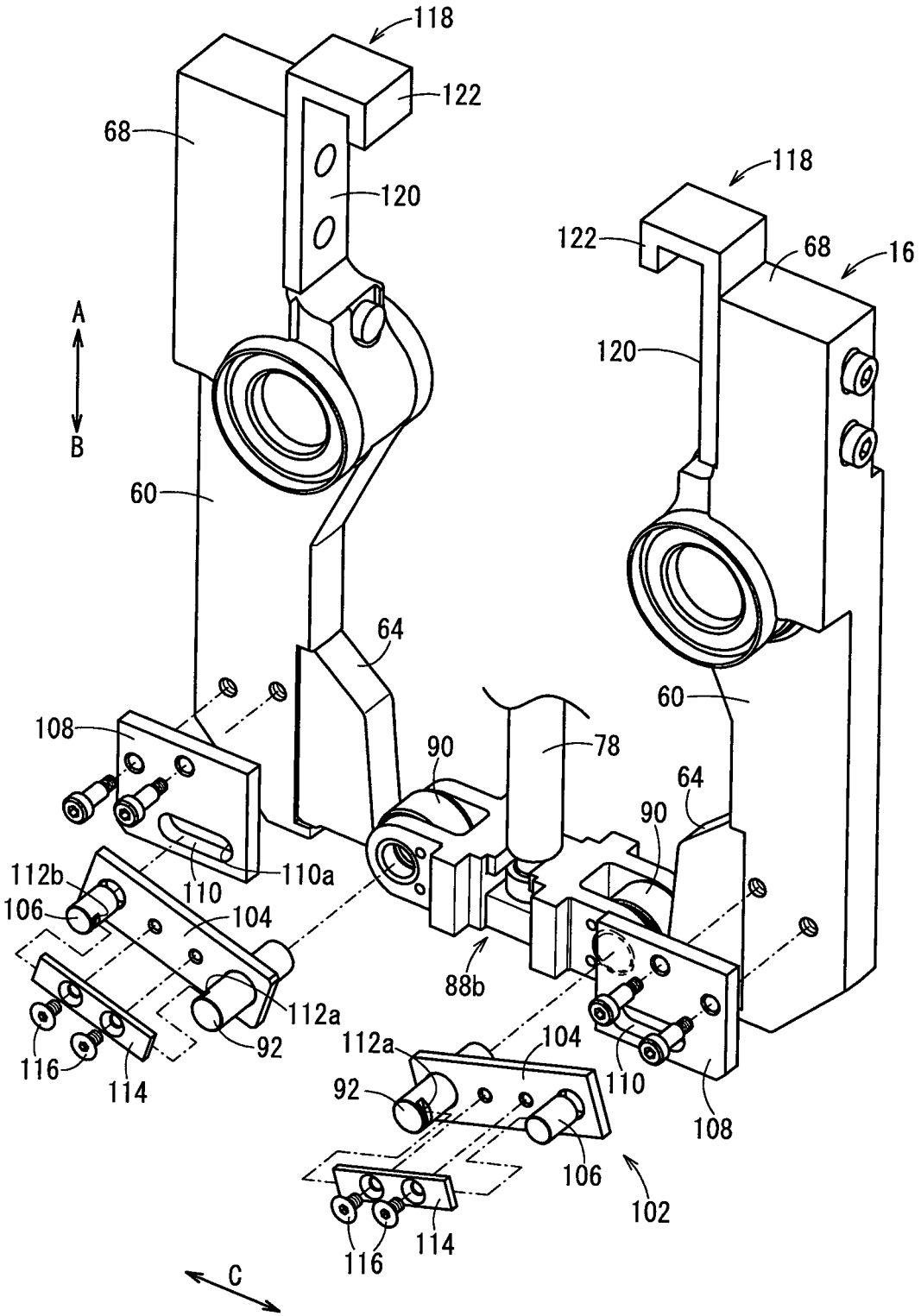
FIG. 10 is an exploded perspective view of an assist mechanism installed on the second clamp arms shown in FIG. 9.
Figure 11:
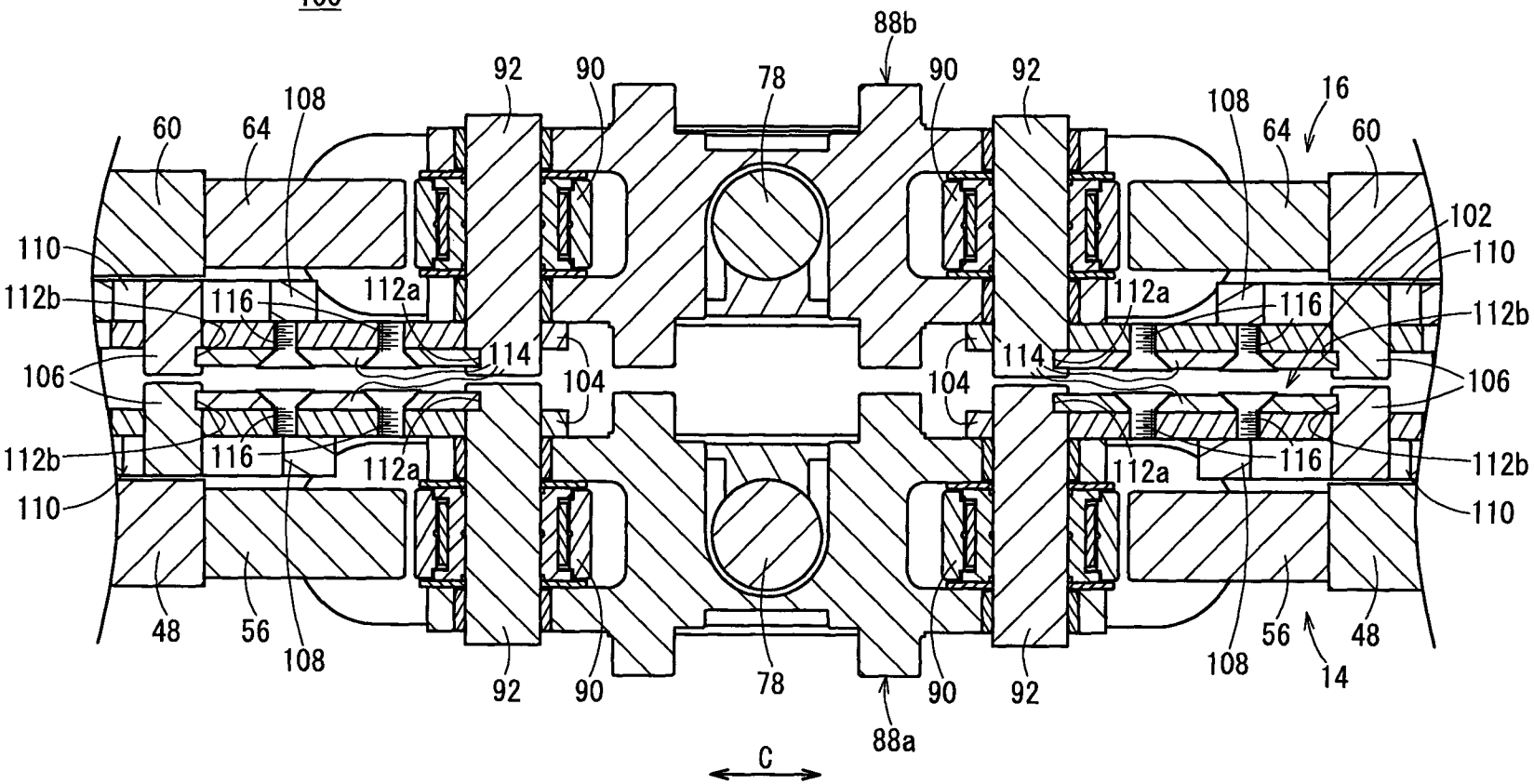
FIG. 11 is a cross sectional view taken along line XI-XI of FIG. 8.

Further, retaining plates 114 are mounted on surfaces of the link plates 104 such that, as shown in FIGS. 10 and 11, ends of the retaining plates 114 are fitted into engagement grooves 112*a*, 112*b*, which are formed respectively on the outer circumferential surfaces of the link pins 106 and the roller pins 92. In addition, the retaining plates 114 are fixed with respect to the link plates 104 by respective pairs of fixing bolts 116.

More specifically, in a condition in which the link pins 106 and the roller pins 92 are inserted through the one end and the other end of the link plates 104, the link pins 106 and the roller pins 92 are retained by the retaining plates 114, whereby pulling or falling out thereof in the axial direction is prevented.

Consequently, the one ends of the link plates 104 are supported rotatably, respectively, through the link pins 106 with respect to the one ends of the first and second clamp arms 14, 16, whereas the other ends thereof are supported rotatably on opposite ends of the block bodies 88*a*, 88*b* through the roller pins 92.

Figure 12:
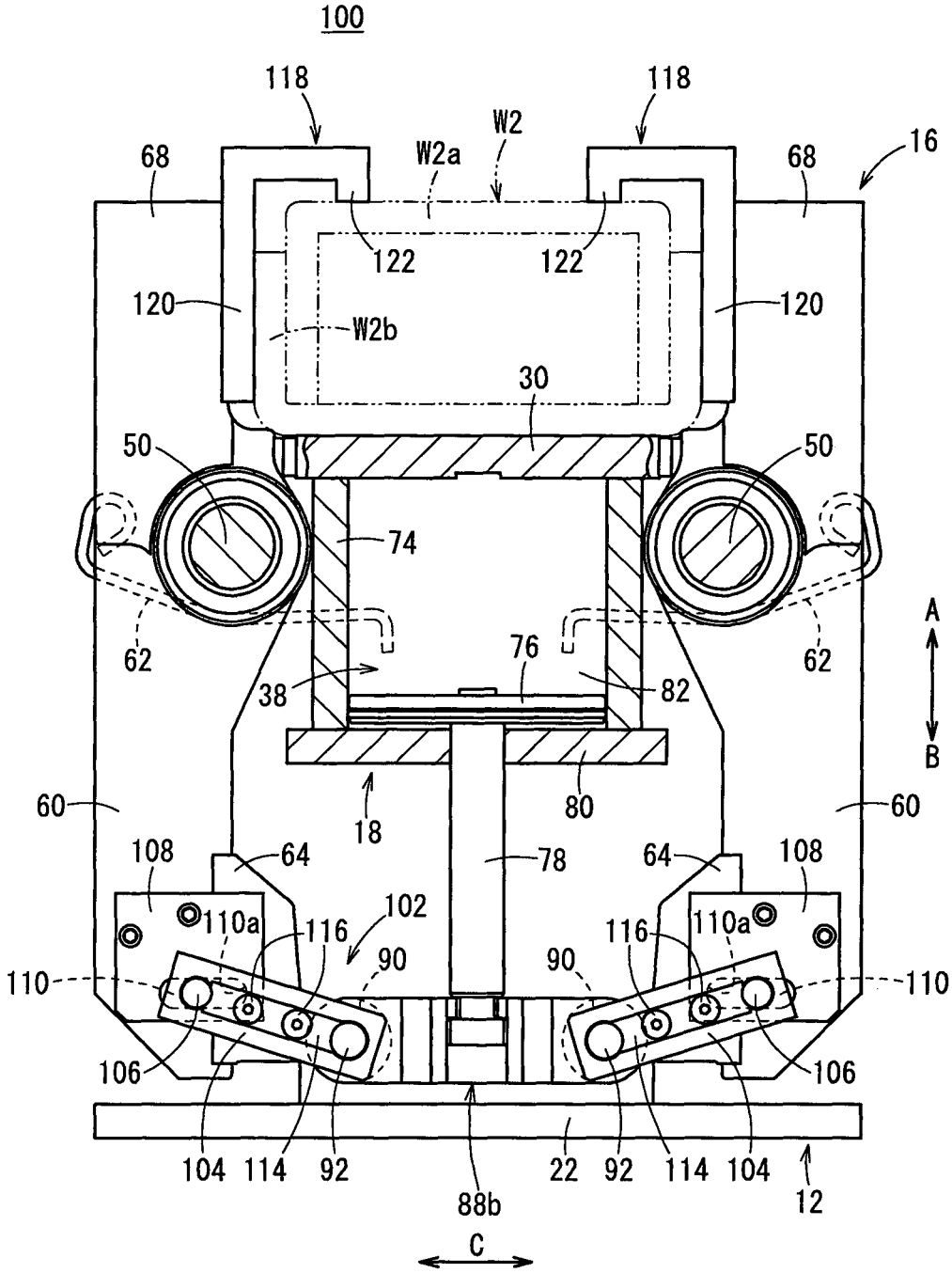
FIG. 12 is a front view, shown partially in cross section, of a clamped state of a second workpiece by second clamp arms, in the clamp apparatus of FIG. 8.

The brackets 108 are made up from substantially rectangular plates, which are installed respectively on side surfaces of the one ends of the first and second clamp arms 14, 16. In the brackets 108, pin grooves 110 are formed (see FIGS. 8 and 12) which extend in a substantially perpendicular direction with respect to the direction of extension of the first and second clamp arms 14, 16. More specifically, as shown in FIG. 12, when the first and second clamp arms 14, 16 are in a clamped state, the pin grooves 110 extend over predetermined lengths in a substantially horizontal direction.

In addition, the link pins 106, which are supported respectively on the other ends of the link plates 104, are inserted into the pin grooves 110, and the other ends of the link plates 104 are supported movably along the pin grooves 110 in directions substantially perpendicular to the direction of extension of the first and second clamp arms 14, 16.

Next, with reference to FIGS. 8 and 12 through 14, a case will be described in which, in the clamp apparatus 100 having the above-described assist mechanism 102, an unclamping operation is carried out from a clamped state, in which the second workpiece W2 is clamped by the second clamp arms 16.

Further, in this case, a situation will be described in which attachments 118 that correspond to the shape of the second workpiece W2 are installed and used on the second gripping members 68 of the second clamp arms 16.

At first, the attachments 118 will briefly be described. As shown in FIGS. 8 and 9, the attachments 118 include flat plate-shaped base portions 120 mounted on the second gripping members 68, and hook portions 122 formed on upper ends of the base portions 120 that project in a substantially perpendicular direction to the base portions 120. Further, lower surfaces of the hook portions 122 are formed in flat shapes substantially perpendicular with respect to the direction of extension of the second clamp arms 16. Stated otherwise, on the attachments 118, the hook portions 122 are formed in hook-like shapes with respect to the base portion 120.

In a state in which the second workpiece W2 is clamped by the second clamp arms 16 on which the attachments 118 are mounted, as shown in FIG. 12, the base portions 120 of the attachments 118 grip the side walls of the second frame W2*b* of the second workpiece W2, whereas the lower surfaces of the hook portions 122 grip the upper surface of the first frame W2*a* of the second workpiece W2. In this case, the assist mechanism 102 is in an inclined condition, in which the other end sides of the link plates 104 are located slightly lower than the one end sides thereof, and the link pins 106 at the one end sides are positioned roughly centrally along the lengthwise direction of the pin grooves 110.

At first, in the event that an unclamped state is to be brought about in which the clamped state of the second workpiece W2 by the second clamp arms 16 is released, by switching the supply state of the pressure fluid to the second cylinder 38, the piston 76 is raised upon being pressed by the pressure fluid, accompanied by the piston rod 78 and the block body 88*b* being raised integrally therewith, and the rollers 90 of the block body 88*b* being raised upwardly along the second cam members 64. Consequently, the pressing force applied to the one end sides of the second clamp arms 16 is extinguished, and under the spring force of the second springs 62, the second gripping members 68 are rotated in directions away from each other.

Further, simultaneously, the other end sides of the link plates 104 of the assist mechanism 102 begin to be rotated while being raised upwardly together with the block body 88*b*. Consequently, the other end sides of the link plates 104 become positioned upwardly (in the direction of the arrow A) with respect to the one end sides thereof, and the link pins 106 on the one end sides start to move in widthwise inward directions along the pin grooves 110. In this case, the link pins 106 still do not reach the inside ends 110*a* of the pin grooves 110.

When the second clamp arms 16 are operated in the foregoing manner to release the clamped state and become unclamped, cases may occur, for example, in which the hook portions 122 of the attachments 118 bite into debris and the like (e.g., welding spatter) that is adhered to the upper surface of the second workpiece W2, such that the unclamping operation of the second clamp arms 16 cannot be accomplished merely by the spring force of the second springs 62 alone.

Figure 13:
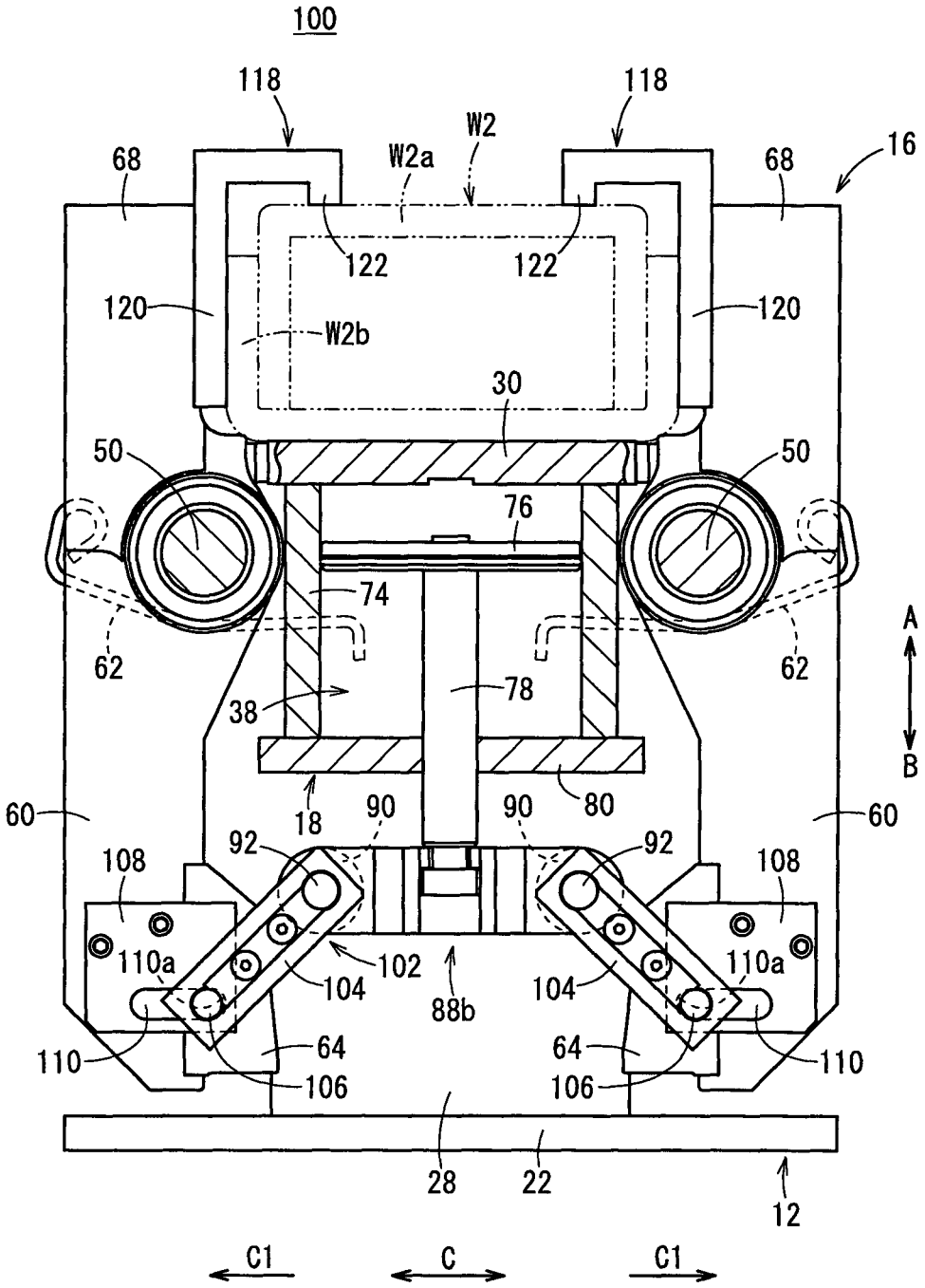
FIG. 13 is a front view, shown partially in cross section, of an intermediate condition in which the clamped state is released and an unclamping operation is performed using an assist mechanism, in the clamp apparatus of FIG. 12.
Figure 14:
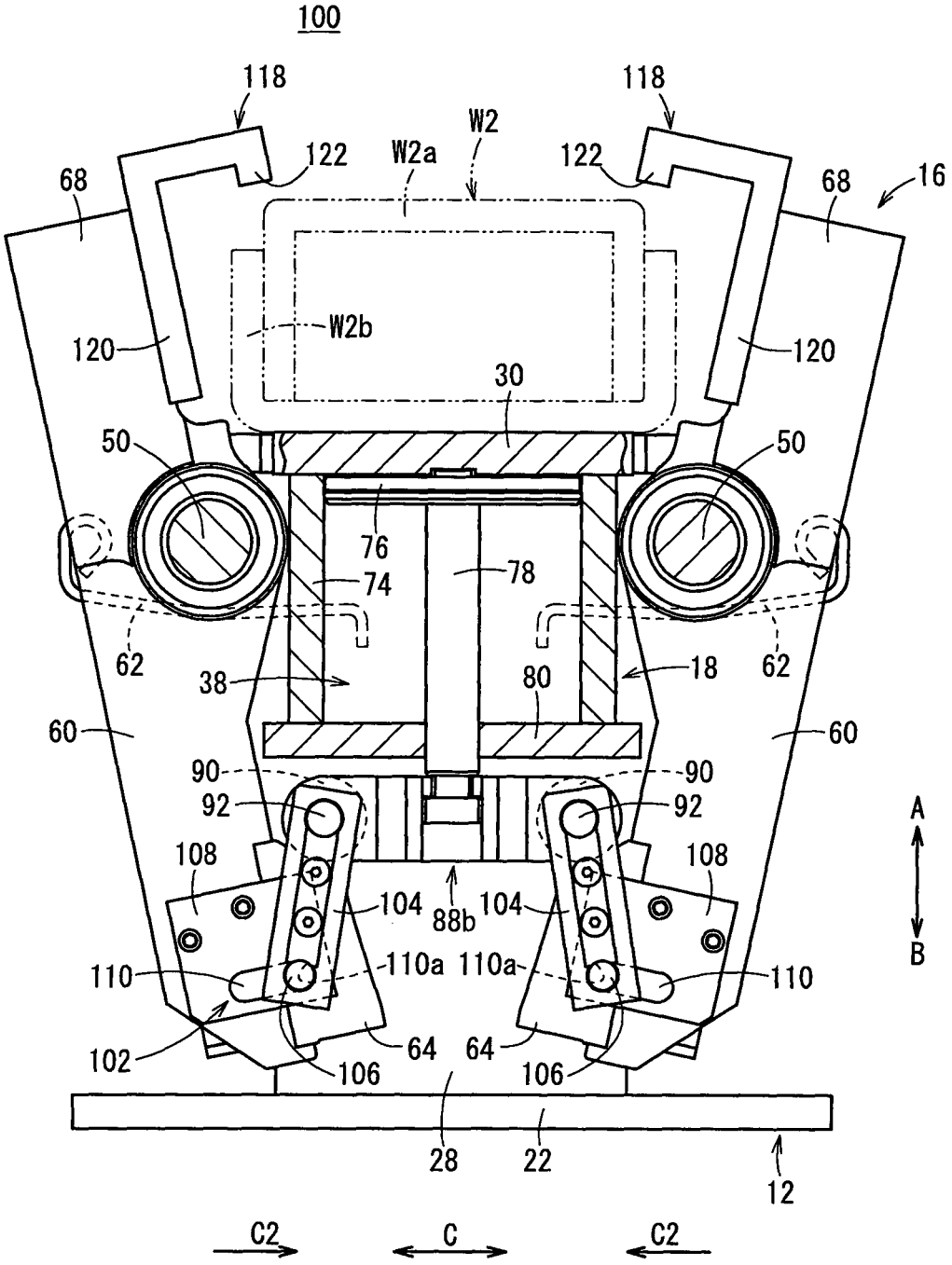
FIG. 14 is a front view, shown partially in cross section, of an unclamped state, in the clamp apparatus of FIG. 12.

In this case as well, i.e., from a state in which the unclamping operation shown in FIG. 13 cannot be performed, by supplying pressure fluid continuously with respect to the second cylinder 38, the block body 88*b* is raised together with the piston 76, and the link plates 104 are rotated further into an upright orientation. As a result, the link pins 106 are moved further toward the widthwise inward sides of the pin grooves 110 (in the directions of the arrows C2), and as shown in FIG. 14, the link pins 106 are moved until they reach the inside ends 110*a* of the pin grooves 110, at which point the inside ends 110*a* are pressed inwardly in the widthwise direction (in the directions of the arrows C2). Stated otherwise, by means of the assist mechanism 102, the one ends of the second clamp arms 16 are pulled in directions (the directions of the arrows C2) to mutually approach one another.

Owing thereto, pressing forces are applied in widthwise inward directions with respect to the one end sides of the second clamp arms 16, and the one end sides can be moved in directions (the directions of the arrows C2) to approach one another. As a result, in addition to the spring force of the second springs 62, pressing forces from the link pins 106, which are imparted thereto by the rotational motion of the link plates 104, are applied to the second clamp arms 16, whereby the unclamping operation can be carried out reliably to release the clamped state.

Stated otherwise, since the thrust force that causes the unclamping operation to be effected on the second clamp arms 16 is a combined force made up of the spring force of the second springs 62 and the pressing forces of the link plates 104, even in the event that the second clamp arms 16 are stuck in the clamped state, the thrust force, which is greater than the spring force of the second springs 62, is imparted to the second clamp arms 16, thereby overcoming the resistance to unclamping, so that the clamped state can reliably be released.

Further, the function of the assist mechanism 102 is not implemented in the case that the unclamping operation on the second clamp arms 16 is capable of being performed solely by the spring force of the second springs 62, and the assist mechanism 102 functions in an auxiliary capacity in the case that unclamping cannot be performed only with the second springs 62.

In the above description, in a condition in which the second workpiece W2 is clamped by the second clamp arms 16, a case has been described in which the unclamping operation cannot be performed, and the unclamping operation is carried out using the assist mechanism 102. However, also in a case in which unclamping of the first clamp arms 14 cannot be performed, the unclamping operation can be implemented in a similar manner using an assist mechanism 102 that is provided on the first clamp arms 14. Concerning operations thereof, since such operations are the same as in the case of the second clamp arms 16, detailed description thereof is omitted.

According to the second embodiment as described above, in the clamp apparatus 100, the link plates 104 of the assist mechanism 102 are disposed rotatably between the one ends of the first and second clamp arms 14, 16 and the rollers 90 that are pivotally supported on the block bodies 88*a*, 88*b*. Owing thereto, when the first and second clamp arms 14, 16 are subjected to the unclamping operation, if for some reason the load thereon is large and the unclamping operation is incapable of being performed solely with the spring forces of the first and second springs 52, 62, by rotation of the link plates 104, a pressing force can be imparted in a widthwise inward direction through the link pins 106 to the one end sides of the first and second clamp arms 14, 16.

As a result, even if for some reason the unclamping operation of the first and second clamp arms 14, 16 cannot be carried out, by rotating the link plates 104 of the assist mechanism 102 under a driving action of the drive unit 18, and thereby pressing the one ends of the first and second clamp arms 14, 16 in directions (the directions of the arrows C2) to approach one another mutually, the first and second clamp arms 14, 16 can reliably be unclamped, and the clamped state of the first and second workpieces W1, W2 can be released.

Further, since the assist mechanism is constituted by a simple structure from the pair of link plates 104, the link pins 106 supported on the ends of the link plates 104, and the brackets 108 having the pin grooves 110 through which the link pins 106 are inserted, the assist mechanism 102 can be installed comparatively easily with respect to an existing clamp apparatus 10 that is not equipped with the assist mechanism 102.

Figure 15:
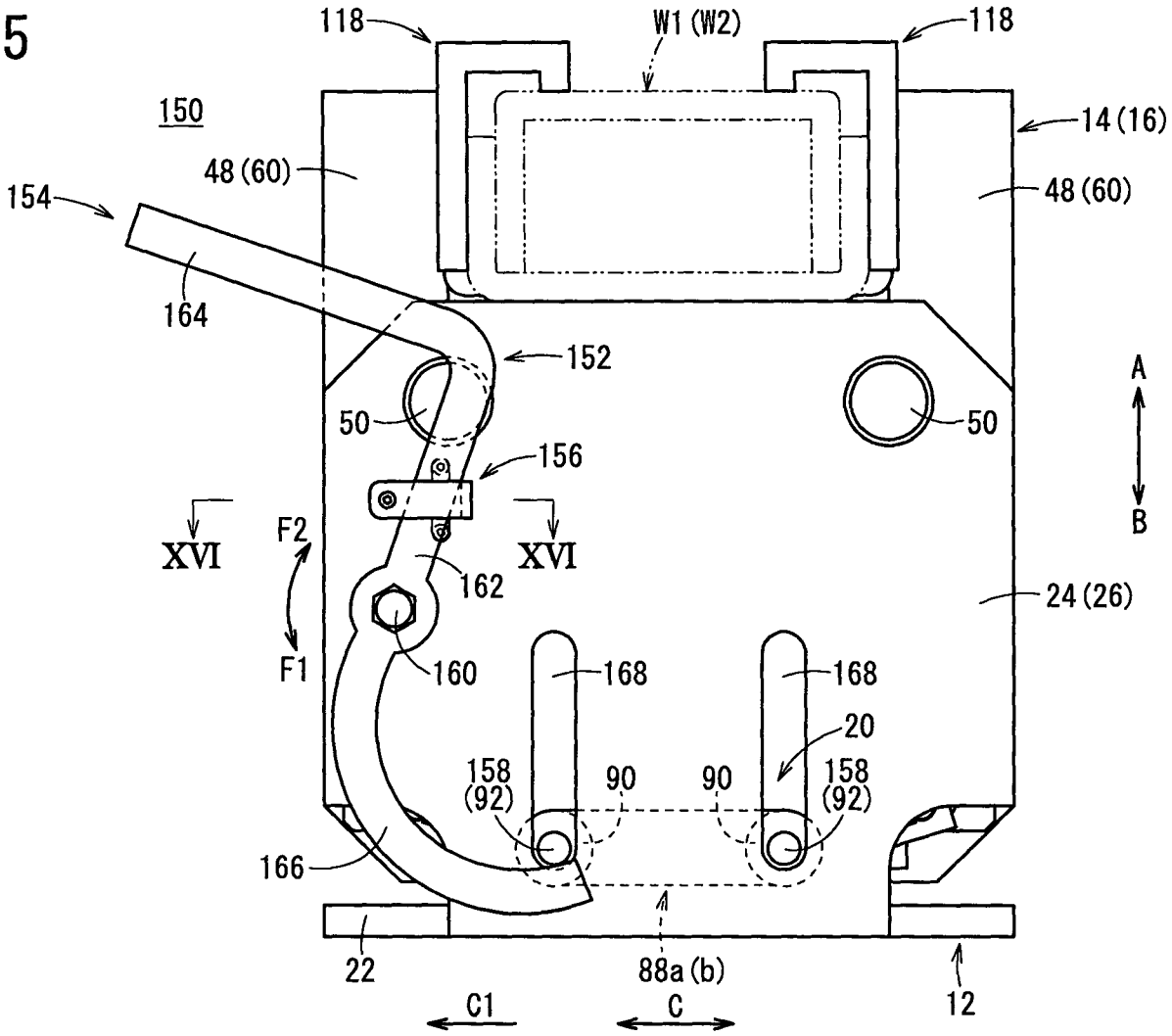
FIG. 15 is a front view of a clamp apparatus according to a third embodiment of the present invention.
Figure 16:
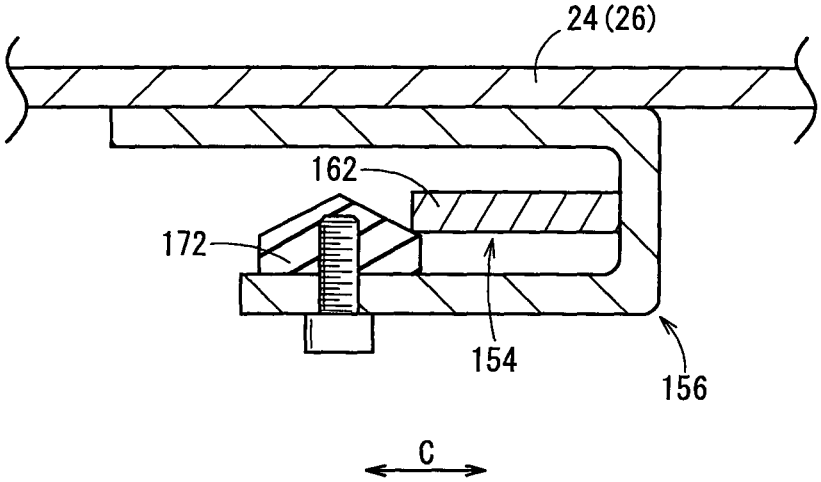
FIG. 16 is a cross sectional view taken along line XVI-XVI of FIG. 15.
Figure 17:
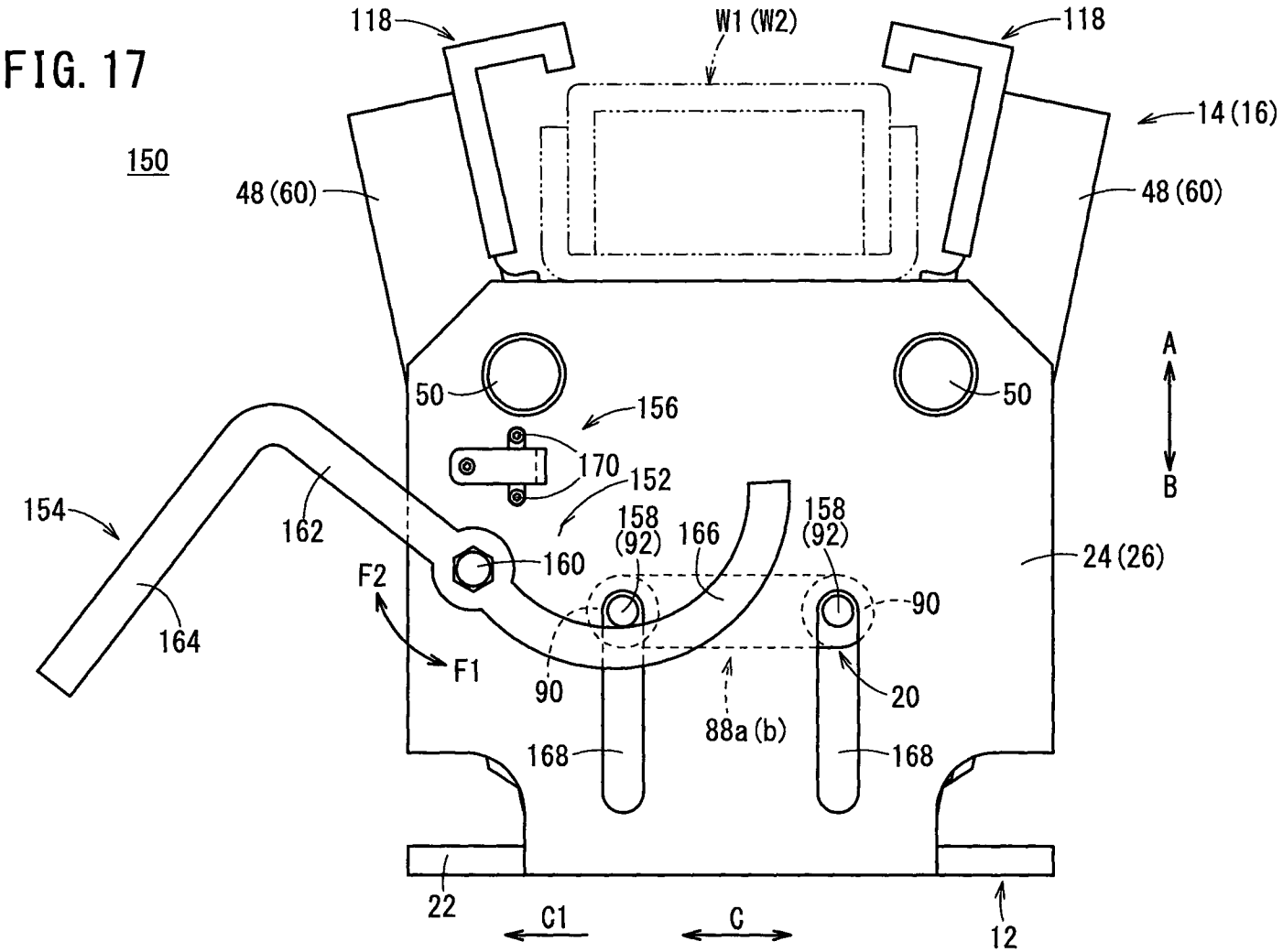
FIG. 17 is a front view showing a condition in which a clamped state is manually released through operation of a manual release mechanism, in the clamp apparatus of FIG. 15.

Next, a clamp apparatus 150 according to a third embodiment is shown in FIGS. 15 through 17. Constituent elements of the clamp apparatus 150, which are the same as those of the clamp apparatus 100 according to the above-described second embodiment, are designated by the same reference characters, and detailed description of such features is omitted.

The clamp apparatus 150 according to the third embodiment differs from the clamp apparatus 100 according to the second embodiment in that, for example, in the case that supply of pressure fluid to the drive unit 18 is stopped during an emergency stoppage of the assembly line on which the clamp apparatus 150 is installed, as shown in FIGS. 15 to 17, a manual release mechanism 152 is provided, which enables the clamped state of the first and second workpieces W1, W2, which are in a clamped condition by the first and second clamp arms 14, 16, to be forcibly released manually.

The manual release mechanism 152 includes release levers 154, which are provided, for example, rotatably with respect to the first and second plates 24, 26 of the body 12 on the side of the first clamp arms 14 and on the side of the second clamp arms 16, respectively, holders 156 that retain the release levers 154, and connecting pins 158 connected to the roller pins 92 that make up the driving force transmission mechanism 20, and which are pressed by the release levers 154.

The connecting pins 158 are not limited to a structure connected separately with respect to the roller pins 92, and may, for example, be formed integrally with the roller pins 92.

Each of the release levers 154, for example, is constituted from a plate having a predetermined thickness, which is disposed rotatably with respect to a side surface of the first or second plate body 24, 26.

The release lever 154 comprises a support member 162, which is supported by a fixing bolt 160 on the first or second plate body 24, 26, an operating member 164 operated by an operator, which is substantially perpendicular with respect to the support member 162 on an upper end of the support member 162, and a pressing member 166, which extends with an arcuate shape in cross section from the lower end of the support member 162 and presses the connecting pin 158.

The pressing member 166 is formed to extend in an opposite direction from the operating member 164 with respect to the support member 162.

Additionally, the operating member 164 is arranged to project in a widthwise outside direction (in the direction of the arrow C1) from the first or second plate body 24, 26, whereas the pressing member 166 is formed with an arcuate shape in cross section with a downwardly oriented convex shape (in the direction of the arrow B).

The connecting pins 158 project from ends of the roller pins 92 and are disposed coaxially therewith. By insertion of the connecting pins 158, respectively, through pairs of insertion grooves 168 that open in the first and second plate bodies 24, 26, the connecting pins 158 project by a predetermined length on the outside of the first and second plate bodies 24, 26. The insertion grooves 168 extend a predetermined length along the vertical direction (the direction of arrows A and B).

As shown in FIGS. 15 and 16, the holders 156 are formed with a U-shape in cross section, for example, from an elastically deformable plate or the like. The holders 156 are connected by bolts 170 (see FIG. 17) to side surfaces of the first and second plate bodies 24, 26, and open in a widthwise outside direction of the first and second plate bodies 24, 26. The support members 162 of the release levers 154 are capable of being inserted into interiors of the holders 156, and are latched therein by latching projections 172 disposed in the vicinity of the openings of the holders 156, to thereby restrict rotational movement of the release levers 154.

Next, a description shall be given concerning a case, in the aforementioned clamp apparatus 150, in which supply of pressure fluid to the drive unit 18 is stopped in a clamped condition of the first workpiece W1 by the first clamp arms 14. In the clamped condition shown in FIG. 15, since the piston 76 and the piston rod 78 of the drive unit 18 are lowered, accompanied by the block body 88*a* and the rollers 90 being lowered therewith, the connecting pins 158 are positioned in the vicinity of the lower ends of the insertion grooves 168.

For example, during an emergency stoppage of the assembly line, in a condition in which supply of pressure fluid to the drive unit 18 is suspended, the clamped state of the first workpiece W1 by the first clamp arms 14 is locked and cannot be released.

In such a situation, in the condition shown in FIG. 15, first, by a non-illustrated operator grasping and pressing the operating member 164 of the release lever 154 downwardly (in the direction of the arrow B), the release lever 154 is rotated counterclockwise (in the direction of the arrow F1) about the supported location of the support member 162. Along therewith, the support member 162 abuts against the latching projection 172 of the holder 156, and by elastic deformation, the support member 162 overcomes the latching projection 172 and is moved outside of the holder 156 from the opening thereof. Additionally, by the release lever 154 becoming completely separated outside of the holder 156, the rotational movement-restricted condition is released.

Further, the operating member 164 is pressed downwardly (in the direction of the arrow B), whereby the pressing member 166 is rotated upwardly (in the direction of the arrow A) about the support member 162, accompanied by the pressing member 166 coming into abutment with the connecting pin 158 and thereafter pressing the connecting pin 158 upwardly, as shown in FIG. 17. Consequently, the roller pins 92 that are connected to the connecting pins 158, the block body 88*a*, the piston rod 78, and the piston 76 are pressed upwardly in unison.

As a result, the rollers 90 are raised along the cam surfaces 58 of the first cam members 56, and by the spring force of the respective first springs 52, an unclamped state is brought about in which the first clamp arms 14 are rotated to separate the first gripping members 54 mutually away from each other (see FIG. 17).

By bringing about the unclamped state through operation of the manual release mechanism 152, even during an emergency stop of the assembly line, the clamped state of the first workpiece W1 can be released to thereby enable easy removal of the first workpiece W1.

After the clamped state has been released by the release lever 154 of the manual release mechanism 152, by a non-illustrated operator grasping the operating member 164 and pushing it upwardly (in the direction of the arrow A), the release lever 154 is rotated clockwise (in the direction of the arrow F2) about the support member 162. Additionally, by inserting the support member 162 inside the holder 156 and latching the support member 162 over the latching projection 172, the release lever 154 is restored again to the locked condition and cannot be rotated, whereupon the release operation of the clamp apparatus is completed.

Further, in the above description, although a case has been described in which a clamped state of the first workpiece W1 by the first clamp arms 14 is released through operation of the manual release mechanism 152, in a clamped state of the second workpiece W2 by the second clamp arms 16 as well, since the clamp releasing process for the case in which supply of pressure fluid to the drive unit 18 is stopped is the same as the case of the first clamp arms 14, detailed explanation thereof is omitted.

According to the third embodiment as described above, for example, the release levers 154 that constitute the manual release mechanism 152 are disposed rotatably on outer sides of the first and second plate bodies 24, 26 that make up the body 12. Further, even in a condition in which supply of pressure fluid to the drive unit 18 is suspended, and the clamped state of the first workpiece W1 or the second workpiece W2 is locked, by operation of the release levers 154, the connecting pins 158 connected to the roller pins 92 can be pressed upwardly.

Therefore, the rollers 90, which are in abutment against the first and second cam members 56, 64 and are pressing the first and second clamp arms 14, 16 in widthwise outside directions, can easily and reliably be moved upwardly (in the direction of the arrow A) along the cam surfaces 58, 66, so that the first and second clamp arms 14, 16 can be unclamped easily and reliably by the spring forces of the first and second springs 52, 62.

Further, with a simple structure made up of the release levers 154, the connecting pins 158, and the insertion grooves 168, since the manual release mechanism 152 can be constructed that enables the clamped state to be released manually, manual release at the time of clamping can easily be performed, for example, by selective attachment of the manual release mechanism 152 with respect to the clamp apparatus 150. Furthermore, corresponding to the installation environment in which the clamp apparatus 150 is installed, the positions where the release levers 154 are installed can suitably be selected from either one of both ends in the widthwise direction of the body 12, or the release levers 154 may be disposed respectively on both of such ends.

The clamp apparatus according to the present invention is not limited to the above embodiments. Various changes and modifications may be made to the embodiments without departing from the scope of the invention as set forth in the appended claims.

The invention claimed is:

1. A clamp apparatus in which, by rotation of clamp arms, a workpiece is clamped between gripping members of the clamp arms, comprising:

a body;

a plurality of drive units, each being disposed on the body, each of the plurality of drive units including a displacement body that is displaced along an axial direction of a respective drive unit and a fluid pressure cylinder that displaces the respective displacement body under a supply of a pressure fluid;

at least two pairs of clamp arms supported rotatably with respect to the body, including a first pair of the clamp arms arranged face-to-face with each other and a second pair of the clamp arms arranged face-to-face with each other, wherein a distance between gripping members of the first pair of the clamp arms when the workpiece is clamped differs from a distance between gripping members of the second pair of the clamp arms when the workpiece is clamped; and a plurality of driving force transmission mechanisms, each including pressing members that press ends of respective clamp arms, the plurality of driving force transmission mechanisms each being connected to a respective drive unit of the plurality of the drive units, and the plurality of driving force transmission mechanisms each transmits to the respective clamp arms through the pressing members a driving force along the axial direction of the respective drive unit, thereby causing rotation of the respective clamp arms, wherein a quantity of the plurality of the drive units corresponds to a quantity of the pairs of the clamp arms, each pair of the pairs of the clamp arms is driven independently by a respective drive unit of the plurality of drive units, the pressing members each roll along a surface of a respective clamp arm that is at an outermost periphery of the respective clamp arm;

a single ceiling body connected to upper ends of the fluid pressure cylinders of all of said plurality of drive units;

fluid pressure supply conduits for the fluid pressure cylinders of all of said plurality of drive units being provided in said single ceiling body; and a switching valve associated with the ceiling body for switching a direction of a pressure fluid supplied by the fluid pressure supply conduits to a selected one of the fluid pressure cylinders.

2. The clamp apparatus according to claim 1, wherein cam members including cam surfaces that are pressed by the pressing members are provided on the ends of the clamp arms, the cam surfaces being inclined with respect to a longitudinal direction of the clamp arms.

3. The clamp apparatus according to claim 2, wherein the pressing members comprise rollers, which are rotatably supported, respectively, on opposite ends of a block body connected to the displacement body, so that the rollers are each disposed in facing relation to a respective clamp arm in one pair of the clamp arms.

4. The clamp apparatus according to claim 1, wherein the clamp arms are biased and placed in an unclamped state by a spring force of springs disposed between the clamp arms and the body.

5. The clamp apparatus of claim 4, further comprising an assist mechanism configured to assist an unclamping operation of the clamp arms by the spring force of the springs.

6. The clamp apparatus according to claim 5, wherein the assist mechanism comprises at least one link, which is disposed rotatably between the ends of the clamp arms and the pressing members, such that when the unclamping operation is performed, the link biases the ends mutually in directions to approach one another accompanying operation of the pressing members.

7. The clamp apparatus according to claim 6, wherein the assist mechanism functions in a case that the unclamping operation cannot be performed with only the spring force of the springs.

8. The clamp apparatus according to claim 5, wherein the assist mechanism functions in a case that the unclamping operation cannot be performed with only the spring force of the springs.

9. The clamp apparatus according to claim 5, the assist mechanism comprising:

a pair of link plates;

a pair of link pins disposed on ends of the link plates; and a pair of pin grooves formed in brackets that are mounted on ends of the clamp arms and in which the link pins are inserted.

10. The clamp apparatus according to claim 1, further comprising a manual release mechanism, which is configured to manually release a clamped state by the clamp arms at a time that the workpiece is clamped.

11. The clamp apparatus according to claim 10, wherein the manual release mechanism comprises at least one lever to press and move the pressing members.

12. The clamp apparatus according to claim 1, wherein attachments are disposed detachably on the gripping members and change the distance between the gripping members of the first or second pair of the clamp arms when the workpiece is clamped.

13. The clamp apparatus according to claim 1, wherein the surface at the outermost periphery of the respective clamp arm on which the pressing members each roll is a cam surface on a cam block, and the cam block is removably fastened to an end of the respective clamp arm by a fastener.

14. The clamp apparatus according to claim 1, wherein a distance between opposing pivot points of one pair of the clamp arms is greater than a distance between opposing pressing members that press the one pair of the clamp arms.

15. The clamp apparatus according to claim 1, wherein the pressing members are each linearly movable in the axial direction of the respective drive unit.

16. The clamp apparatus according to claim 1, wherein the surface at the outermost periphery of the respective clamp arm on which the pressing members each roll is a cam surface on a cam block, and the cam surface includes only rectilinear segments.

* * * * *